US008393935B2

(12) United States Patent
Kimura et al.

(10) Patent No.: US 8,393,935 B2
(45) Date of Patent: Mar. 12, 2013

(54) POLISHING APPARATUS

(75) Inventors: Norio Kimura, Tokyo (JP); Kenya Ito, Tokyo (JP); Tamami Takahashi, Tokyo (JP); Masaya Seki, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 12/673,294

(22) PCT Filed: Jul. 23, 2008

(86) PCT No.: PCT/JP2008/063611

§ 371 (c)(1),
(2), (4) Date: Mar. 16, 2011

(87) PCT Pub. No.: WO2009/022539

PCT Pub. Date: Feb. 19, 2009

(65) Prior Publication Data

US 2011/0165825 A1 Jul. 7, 2011

(30) Foreign Application Priority Data

Aug. 16, 2007 (JP) ..... 2007-212497

(51) Int. Cl.
*B24B 9/00* (2006.01)
*B24B 21/00* (2006.01)

(52) U.S. Cl. ..... 451/168; 451/296; 451/303

(58) Field of Classification Search ..... 451/168, 451/64, 296, 302, 303, 311
See application file for complete search history.

(56) References Cited

U.S. PATENT DOCUMENTS

| | | | | |
|---|---|---|---|---|
| 7,108,582 | B2 * | 9/2006 | Sato et al. | 451/11 |
| 7,682,225 | B2 * | 3/2010 | Hongo et al. | 451/303 |
| 7,993,485 | B2 * | 8/2011 | Wasinger et al. | 156/345.12 |
| 8,029,333 | B2 * | 10/2011 | Takahashi et al. | 451/8 |
| 8,047,896 | B2 * | 11/2011 | Takahashi et al. | 451/6 |
| 2001/0011002 | A1 * | 8/2001 | Steere, III | 451/168 |
| 2002/0098787 | A1 * | 7/2002 | Kunisawa et al. | 451/307 |
| 2004/0106363 | A1 | 6/2004 | Ishii et al. | |
| 2004/0185751 | A1 * | 9/2004 | Nakanishi et al. | 451/5 |
| 2009/0093192 | A1 * | 4/2009 | Takahashi et al. | 451/6 |

FOREIGN PATENT DOCUMENTS

| | | |
|---|---|---|
| JP | 5-293746 | 11/1993 |
| JP | 08-147685 | 6/1996 |

(Continued)

OTHER PUBLICATIONS

International Search Report issued Aug. 26, 2008 in International (PCT) Application No. PCT/JP2008/063611.

(Continued)

*Primary Examiner* — Dung Van Nguyen
(74) *Attorney, Agent, or Firm* — Wenderoth, Lind & Ponack, L.L.P.

(57) ABSTRACT

A polishing apparatus polishes a periphery (a bevel portion, a notch portion, an edge-cut portion) of a substrate by bringing a polishing tool into sliding contact with the periphery of the substrate. The polishing apparatus includes a substrate holder configured to hold the substrate, and a polishing head configured to polish the periphery of the substrate held by the substrate holder using the polishing tool. The polishing head includes a press pad for pressing the polishing tool against the periphery of the substrate, and a linear motor configured to reciprocate the press pad.

6 Claims, 28 Drawing Sheets

FOREIGN PATENT DOCUMENTS

| | | |
|---|---|---|
| JP | 8-174399 | 7/1996 |
| JP | 2001-269850 | 10/2001 |
| JP | 2001-300827 | 10/2001 |
| JP | 2002-93755 | 3/2002 |
| JP | 2003-234314 | 8/2003 |
| JP | 2004-098195 | 4/2004 |
| JP | 2005-193326 | 7/2005 |
| JP | 2006-142398 | 6/2006 |
| JP | 2006-283892 | 10/2006 |
| JP | 2006-303112 | 11/2006 |
| KR | 10-2004-0060178 | 7/2004 |
| WO | 2006/112531 | 10/2006 |

OTHER PUBLICATIONS

Supplementary European Search Report issued Dec. 6, 2012 in corresponding European Patent Application No. 08791844.7.

* cited by examiner

POLISHING APPARATUS

TECHNICAL FIELD

The present invention relates to a polishing apparatus for polishing a periphery of a substrate, such as a semiconductor wafer.

BACKGROUND ART

From a viewpoint of improving a yield in semiconductor fabrications, management of a surface condition in a periphery of a semiconductor wafer has recently been receiving attention. In semiconductor fabrication processes, a number of materials are deposited on a wafer repeatedly to form multilayer structures. As a result, unwanted materials and roughened surface are formed on the periphery which is not used for products. It has been more common in recent years to transfer the wafer by holding only the periphery of the wafer. Under such situations, the unwanted materials may come off the periphery onto device surfaces during various processes, resulting in a lowered yield. Thus, it has been customary to polish the periphery of the wafer using a polishing apparatus so as to remove the unwanted copper film and the roughened surface.

In this specification, a bevel portion, a notch portion, and an edge-cut portion will be collectively referred to as a periphery. The bevel portion is, in FIG. 1A, a portion B where a cross section has a curvature at an edge of a wafer W. A flat portion indicated by a symbol D in FIG. 1A is a region where devices are formed. A flat portion E between the device-formation region D and the bevel portion B is referred to as an edge-cut portion, which is distinguished from the device-formation region D. That is, the periphery is a rounded section extending from the edge-cut portion E to a rear surface of the wafer W. A distance from a boundary between the edge-cut portion E and the device-formation region D to the outermost periphery is approximately 6 mm. On the other hand, the notch portion is, as shown in FIG. 1B, a V-shaped cut portion formed on the edge of the wafer W, indicated by a symbol N in FIG. 1B.

A polishing apparatus using a polishing tape is known as an apparatus for removing a film formed on the bevel portion or the notch portion of the wafer (for example, see Japanese laid-open patent publications No. 8-174399 and No. 2002-93755). This type of polishing apparatus has a press pad arranged at a rear side of the polishing tape and is configured to press a polishing surface of the polishing tape against the wafer to thereby polish the bevel portion or the notch portion of the wafer.

The polishing apparatus of this type is configured to reciprocate the press pad and the polishing tape to bring the polishing surface of the polishing tape into sliding contact with the wafer to thereby polish the wafer. Typically, a mechanism for causing the reciprocation of the press pad is constituted by a cam (a rotary element) and a rod (a linearly moving element) for conversion of rotary movement into backwards-and-forwards movement. The rod is pushed against the cam by a spring and thus, contact between the cam and the rod is maintained at all times.

In order to increase a removal rate, it is typically necessary to increase a speed of the reciprocating polishing tape. However, in the above-described reciprocating mechanism, when the cam is rotated at a high speed, the linearly-moving rod cannot follow the cam and as a result, oscillation of reciprocation becomes small. There is another type of reciprocating mechanism which does not use a spring. However, this type of mechanism needs a coupling mechanism for keeping contact between the cam and the rod at all times, and a large load is exerted on the coupling mechanism. For these reasons, the conventional polishing apparatus cannot increase the removal rate greatly.

SUMMARY OF THE INVENTION

The present invention has been made in view of the above drawbacks. It is therefore an object of the present invention to provide a polishing apparatus capable of polishing a periphery of a substrate at a high removal rate.

In order to solve the above drawbacks, one aspect of the present invention is a polishing apparatus for polishing a periphery of a substrate by bringing a polishing tool into sliding contact with the periphery of the substrate, said apparatus comprising: a substrate holder configured to hold the substrate; and a polishing head configured to polish the periphery of the substrate held by said substrate holder using the polishing tool, wherein said polishing head includes a press pad for pressing the polishing tool against the periphery of the substrate, and a linear motor configured to reciprocate said press pad.

In a preferred aspect of the present invention, said polishing head has a linear guide configured to restrict a reciprocating motion of said press pad to a linear reciprocating motion.

In a preferred aspect of the present invention, said press pad includes: a pad body; a plate-shaped pressing section having a pressing surface for pressing the polishing tool against the periphery of the substrate and having a rear surface opposite to said pressing surface; and a plurality of coupling sections coupling said pressing section to said pad body, a space being formed between said rear surface of said pressing section and said pad body.

In a preferred aspect of the present invention, said polishing head includes a driving mechanism configured to move said press pad toward the periphery of the substrate.

In a preferred aspect of the present invention, the polishing apparatus further comprises a tilting mechanism configured to tilt said polishing head with respect to a surface of the substrate held by said substrate holder.

In a preferred aspect of the present invention, the polishing tool is a polishing tape having a polishing surface.

According to the present invention, the linear motor is used to as the reciprocating mechanism. This configuration can reciprocate the press pad and the polishing tool at a high speed. Therefore, the polishing apparatus according to the present invention can greatly increase the removal rate of the periphery of the substrate, compared with the conventional polishing apparatus.

DETAILED DESCRIPTION OF THE INVENTION

Embodiments of the present invention will be described below with reference to the drawings.

Figure 2:
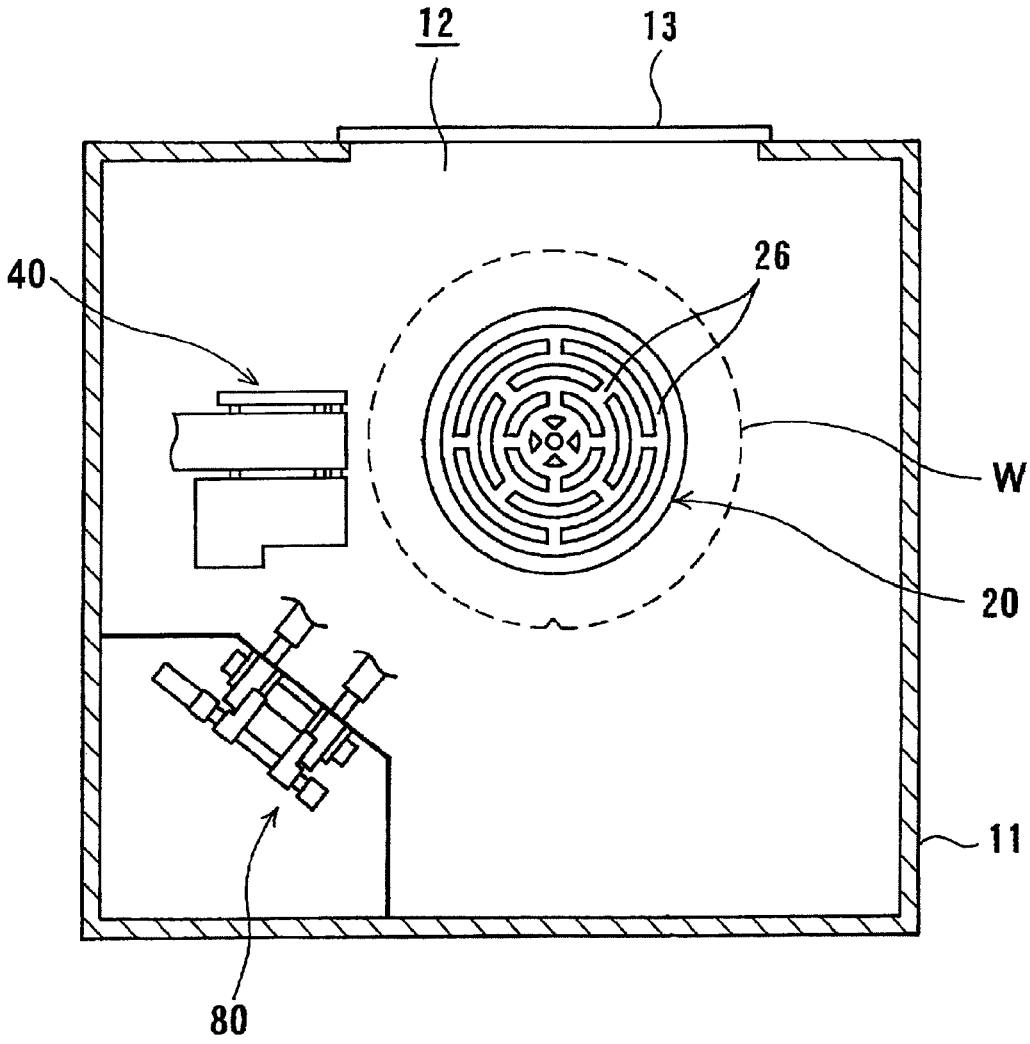
FIG. 2 is a plan view showing a polishing apparatus according to a first embodiment of the present invention.
Figure 3:
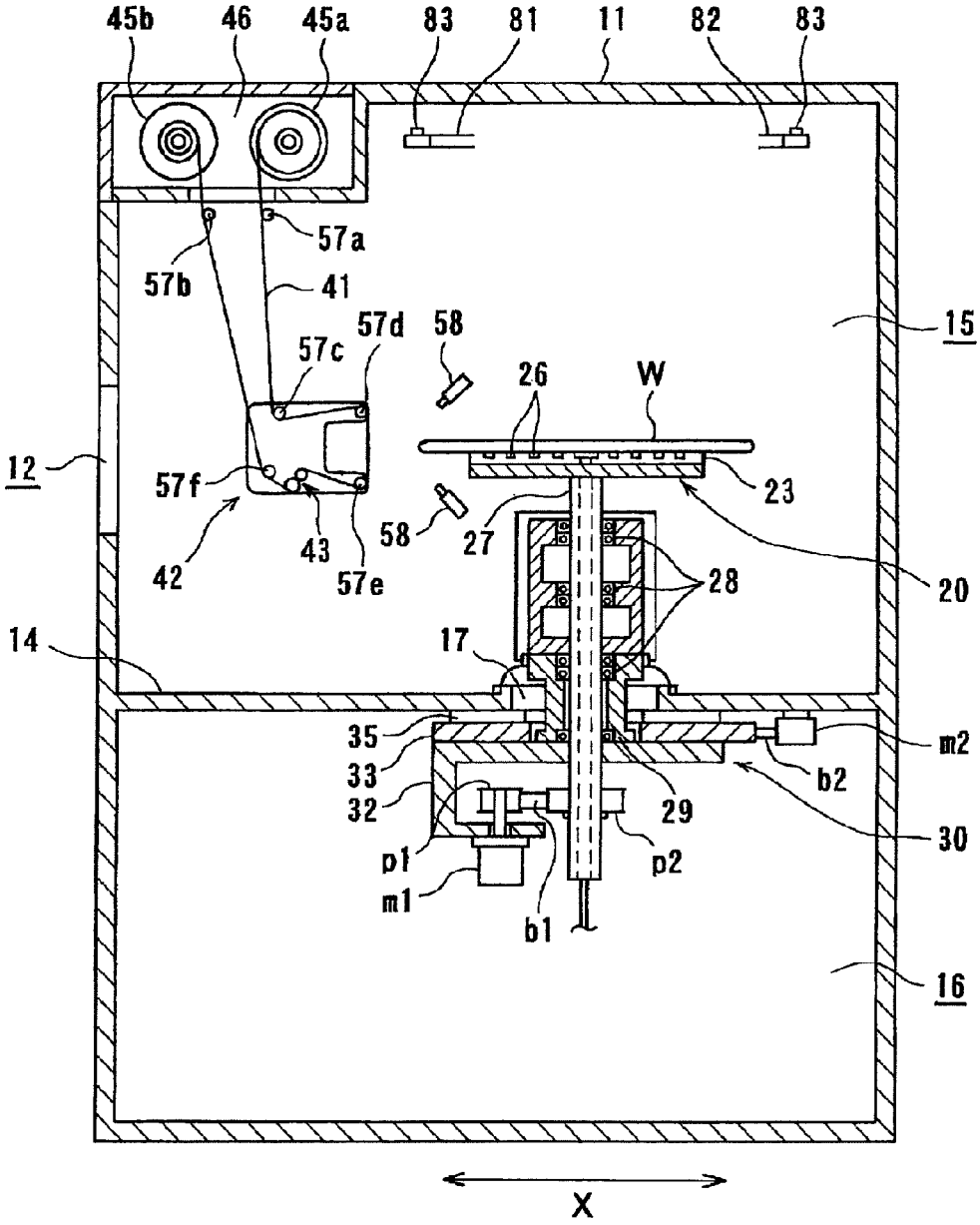
FIG. 3 is a cross-sectional view of the polishing apparatus shown in FIG. 2.

FIG. 2 is a plan view showing a polishing apparatus according to a first embodiment of the present invention. FIG. 3 is a cross-sectional view of the polishing apparatus shown in FIG. 2. The polishing apparatus according to the first embodiment is a bevel polishing apparatus for polishing a bevel portion of a wafer.

As shown in FIG. 2 and FIG. 3, the polishing apparatus according to the first embodiment includes a wafer stage unit (a substrate holder) 20 having a wafer stage 23 for holding a wafer W, a stage moving mechanism 30 for moving the wafer stage unit 20 in a direction parallel to an upper surface (i.e., a wafer holding surface) of the wafer stage 23, and a bevel polishing unit 40 for polishing the bevel portion of the wafer W held on the wafer stage 23.

The wafer stage unit 20, the stage moving mechanism 30, and the bevel polishing unit 40 are contained in a housing 11. The housing 11 is partitioned by a partition plate 14 into two spaces: an upper chamber (a polishing chamber) 15; and a lower chamber (a machine chamber) 16. The above-mentioned wafer stage 23 and the bevel polishing unit 40 are located in the upper chamber 15, while the stage moving mechanism 30 is located in the lower chamber 16. A side wall of the upper chamber 15 has an opening 12. This opening 12 is closed by a shutter 13, which is actuated by an air cylinder (not shown).

The wafer W is transported into and from the housing 11 through the opening 12. Transporting of the wafer W is performed by a known wafer transporting mechanism (not shown), such as a transfer robot. The upper surface of the wafer stage 23 has a plurality of grooves 26. These grooves 26 communicate with a vacuum pump (not shown) via a hollow shaft 27 extending vertically. When the vacuum pump is set in motion, vacuum is produced in the grooves 26, whereby the wafer W is held on the upper surface of the wafer stage 23. The hollow shaft 27 is rotatably supported by bearings 28 and is further coupled to a rotating shaft of a motor m1 through pulleys p1, p2 and a belt b1. With this structure, the wafer W is rotated by the motor m1 while being held on the upper surface of the wafer stage 23. Accordingly, a rotating mechanism for rotating the wafer stage unit 20 is constituted by the hollow shaft 27, the pulleys p1, p2, the belt b1, and the motor m1.

The polishing apparatus further includes a wafer chuck mechanism 80 arranged in the housing 11. The wafer chuck mechanism 80 is configured to receive the wafer W, which has been transported into the housing 11 by the above-described wafer transporting mechanism, and place the wafer W onto the wafer stage 23. Further, the wafer chuck mechanism 80 is configured to remove the wafer W from the wafer stage 23 and transfer the wafer W to the above-described wafer transporting mechanism. Only part of the wafer chuck mechanism 80 is illustrated in FIG. 2.

Figure 4:
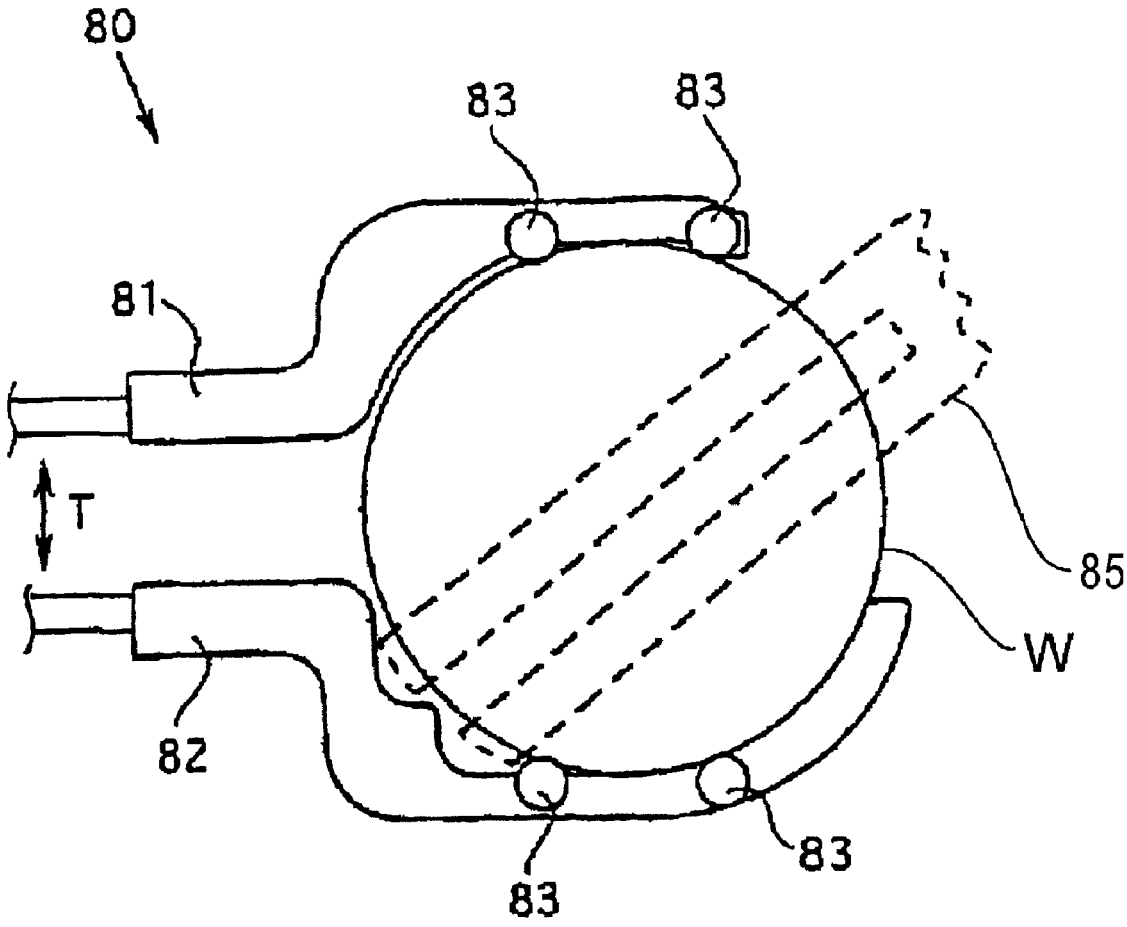
FIG. 4 is a plan view showing chuck hands of a wafer chuck mechanism.

FIG. 4 is a plan view showing chuck hands of the wafer chuck mechanism 80. The wafer chuck mechanism 80 has, as shown in FIG. 4, a first chuck hand 81 having a plurality of pins 83 and a second chuck hand 82 having a plurality of pins 83. These first chuck hand 81 and second chuck hand 82 are moved in directions (indicated by arrows T) closer to and away from each other by an opening and closing mechanism (not shown). Further, the first chuck hand 81 and the second chuck hand 82 are moved in directions perpendicular to the surface of the wafer W held by the wafer stage 23 by a chuck moving mechanism (not shown).

A hand 85 of the wafer transporting mechanism transports the wafer W to a position between the first chuck hand 81 and the second chuck hand 82. When the first chuck hand 81 and the second chuck hand 82 are moved closer to each other, the pins 83 of the first and second chuck hands 81 and 82 are brought into contact with a periphery of the wafer W, whereby the first chuck hand 81 and the second chuck hand 82 can hold the wafer W therebetween. A center of the wafer W and a center of the wafer stage 23 (i.e., a rotational axis of the wafer stage 23) agree with each other when the wafer W is held by the first and second chuck hands 81 and 82. Therefore, the first chuck hand 81 and the second chuck hand 82 function as a centering mechanism.

As shown in FIG. 3, the stage moving mechanism 30 includes a cylindrical shaft base 29 for rotatably supporting the hollow shaft 27, a support plate 32 to which the shaft base 29 is secured, a movable plate 33 capable of moving integrally with the support plate 32, a ball screw b2 coupled to the movable plate 33, and a motor m2 for rotating the ball screw b2. The movable plate 33 is coupled to a lower surface of the partition plate 14 via linear guides 35 that allow the movable plate 33 to move in directions parallel to the upper surface of the wafer stage 23. The shaft base 29 extends through a through-hole 17 of the partition plate 14. The above-mentioned motor m1 for rotating the hollow shaft 27 is secured to the support plate 32.

With this structure, when the ball screw b2 is rotated by the motor m2, the movable plate 33, the shaft base 29, and the hollow shaft 27 move in the longitudinal direction of the linear guides 35 to cause the wafer stage 23 to move in the direction parallel to the upper surface of the wafer stage 23. In FIG. 3, the moving direction of the wafer stage 23 by the stage moving mechanism 30 is indicated by arrows X.

As shown in FIG. 3, the bevel polishing unit 40 includes a polishing head 42 configured to press a polishing tape (i.e., a polishing tool) 41 against the bevel portion of the wafer W, a supply reel 45*a* for supplying the polishing tape 41 to the polishing head 42, and a recovery reel 45*b* for taking up the polishing tape 41 that has been fed to the polishing head 42. The supply reel 45*a* and the recovery reel 45*b* are housed in a reel chamber 46 located in the housing 11 of the polishing apparatus.

The polishing head 42 has a tape-sending mechanism 43 configured to send the polishing tape 41 and a plurality of guide rollers 57*c*, 57*d*, 57*e*, and 57*f* for guiding a traveling direction of the polishing tape 41. The tape-sending mechanism 43 includes a tape-sending roller and a tape-holding roller. The tape-sending mechanism 43 grasps the polishing tape 41 by sandwiching the polishing tape 41 between the tape-sending roller and the tape-holding roller, and moves the polishing tape 41 by rotating the tape-sending roller. The polishing tape 41 is drawn out from the supply reel 45*a* by the tape-sending mechanism 43 and travels toward the polishing head 42 via a guide roller 57*a*. The polishing head 42 brings the polishing surface of the polishing tape 41 into contact with the bevel portion of the wafer W. The polishing tape 41, which has contacted the bevel portion, travels through a guide roller 57*b* and is taken up by the recovery reel 45*b*. As shown in FIG. 3, polishing liquid supply nozzles 58 are disposed above and below the wafer W, respectively, so as to supply a polishing liquid or cooling water to a contact region between the wafer W and the polishing tape 41.

The polishing tape 41 can be constituted by a base film and abrasive particles, such as diamond particles or SiC particles, bonded to one side surface of the base film. This surface with the abrasive particles provides the polishing surface. The abrasive particles to be bonded to the polishing tape 41 are selected according to a type of wafer W and a required polishing capability. Examples of the abrasive particles to be used include diamond particles and SiC particles having an average diameter ranging from 0.1 μm to 5.0 μm. A belt-shaped polishing cloth with no abrasive particles can also be used. The base film may be a film made from a flexible material, such as polyester, polyurethane, or polyethylene terephthalate.

Figure 5:
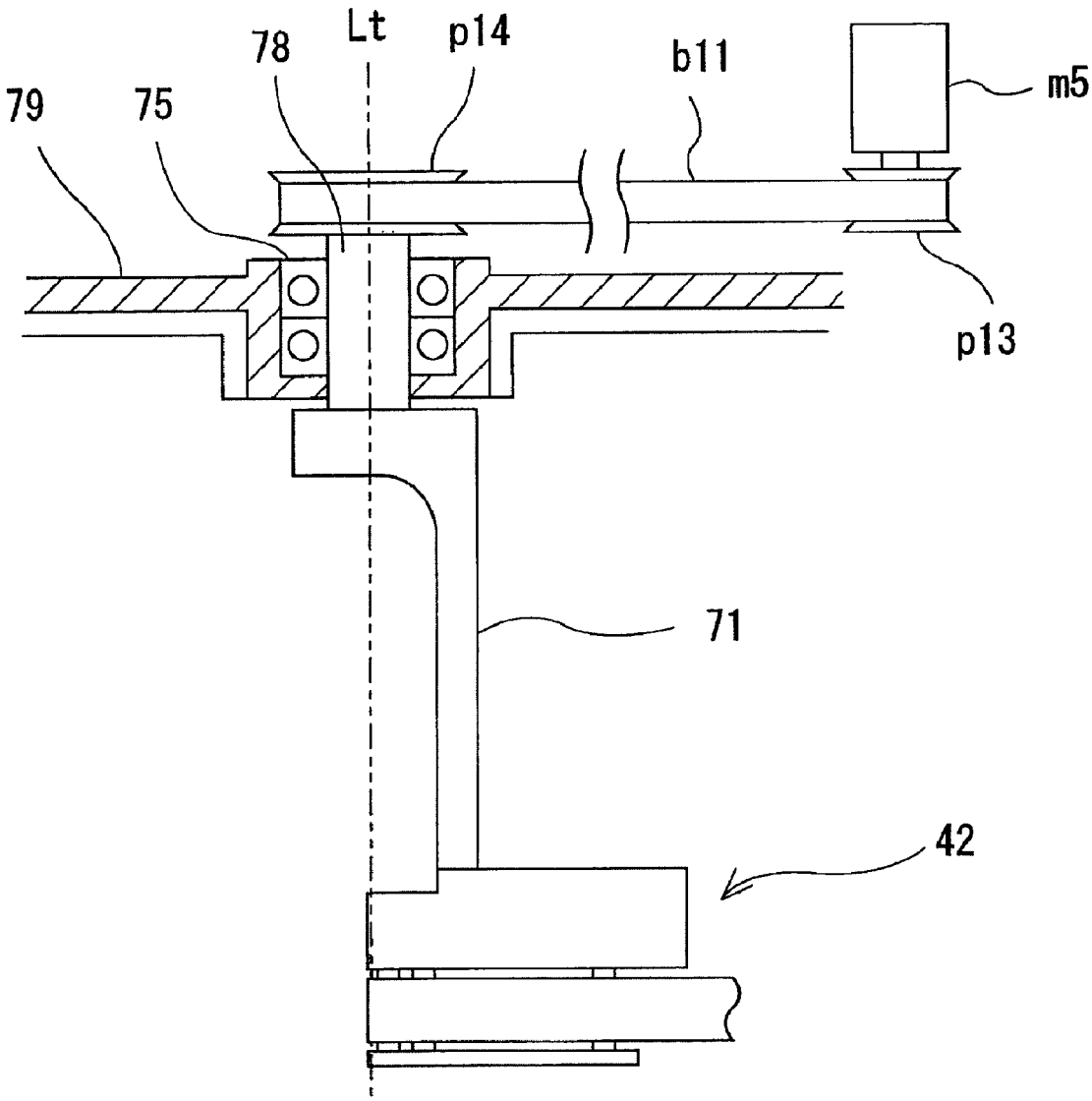
FIG. 5 is a view showing a tilting mechanism for tilting a polishing head with respect a surface of a wafer.

FIG. 5 is a view showing a tilting mechanism for tilting the polishing head 42 with respect to the surface of the wafer W. As shown in FIG. 5, the polishing head 42 is secured to one end of a support arm 71, and a support shaft 78 is secured to the other end of the support arm 71. The support shaft 78 is rotatably supported by a bearing 75 secured to a housing 79 of the bevel polishing unit 40. The support shaft 78 is coupled to a rotational shaft of a motor m5 as a drive source via pulleys p13, p14 and a belt b11. A polishing point is positioned on a center line Lt of the support shaft 78. Therefore, by rotating the support shaft 78 by the motor m5, the polishing head 42 in its entirety can be rotated (i.e., tilted) about the polishing point. In the present embodiment, the tilting mechanism for tilting the polishing head 42 around the polishing point is constituted by the support shaft 78, the pulleys p13, p14, the belt b11, and the motor m5.

Figure 6:
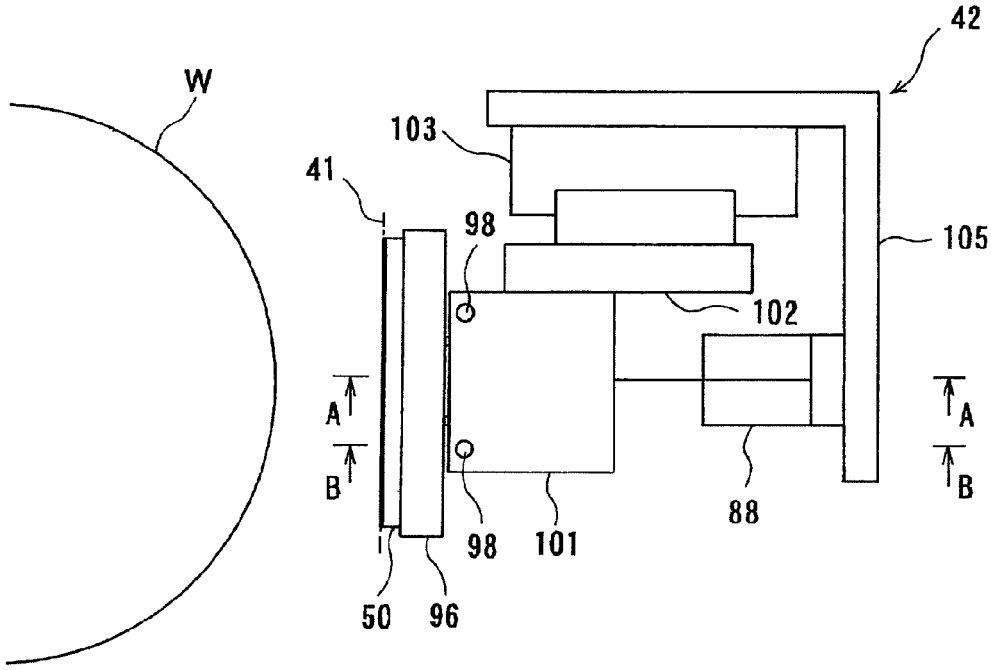
FIG. 6 is a plan view showing interior structures of the polishing head shown in FIG. 3.
Figure 7:
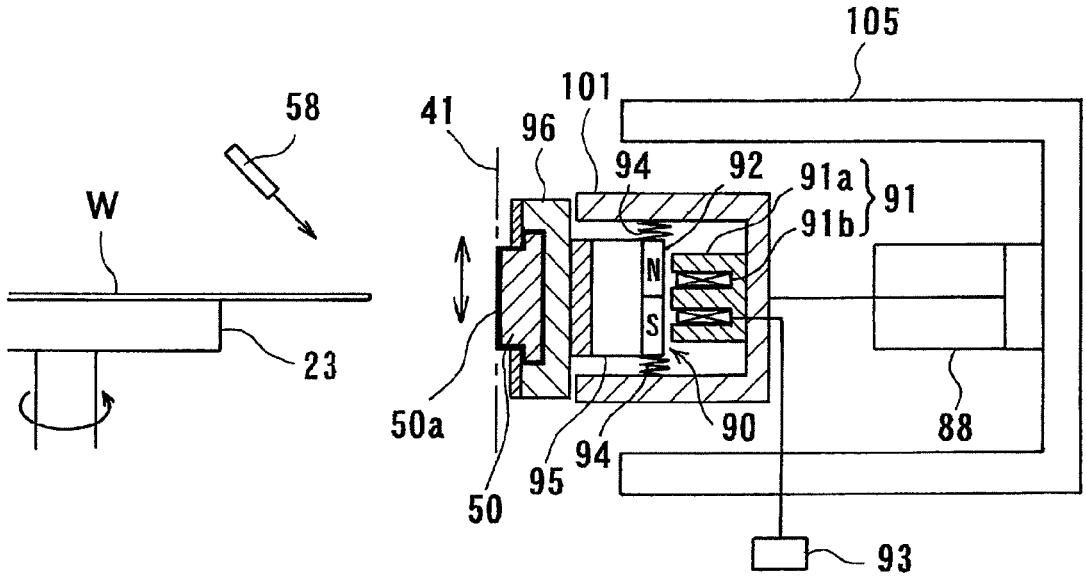
FIG. 7 is a cross-sectional view taken along line A-A in FIG. 6.
Figure 8:
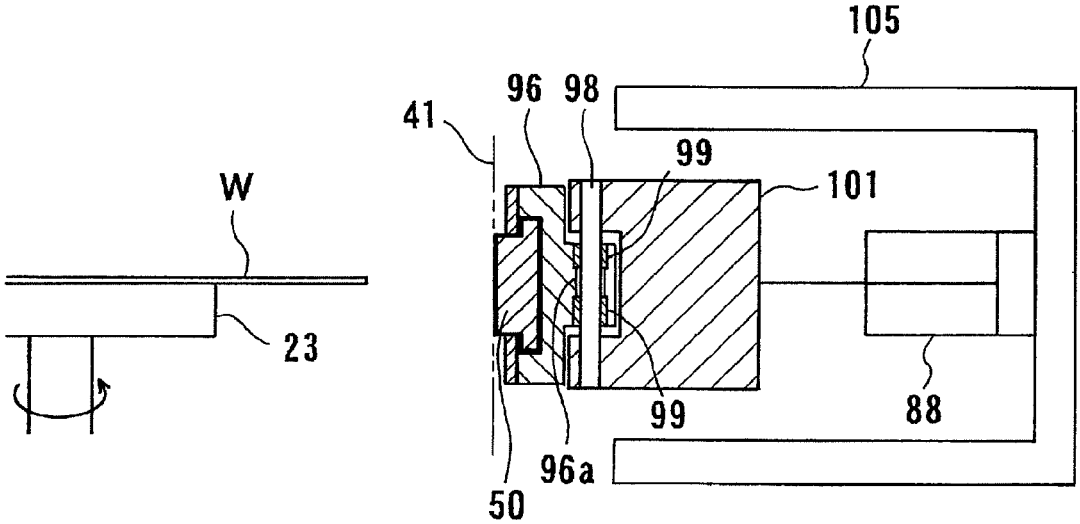
FIG. 8 is a cross-sectional view taken along line B-B in FIG. 6.
Figure 9:
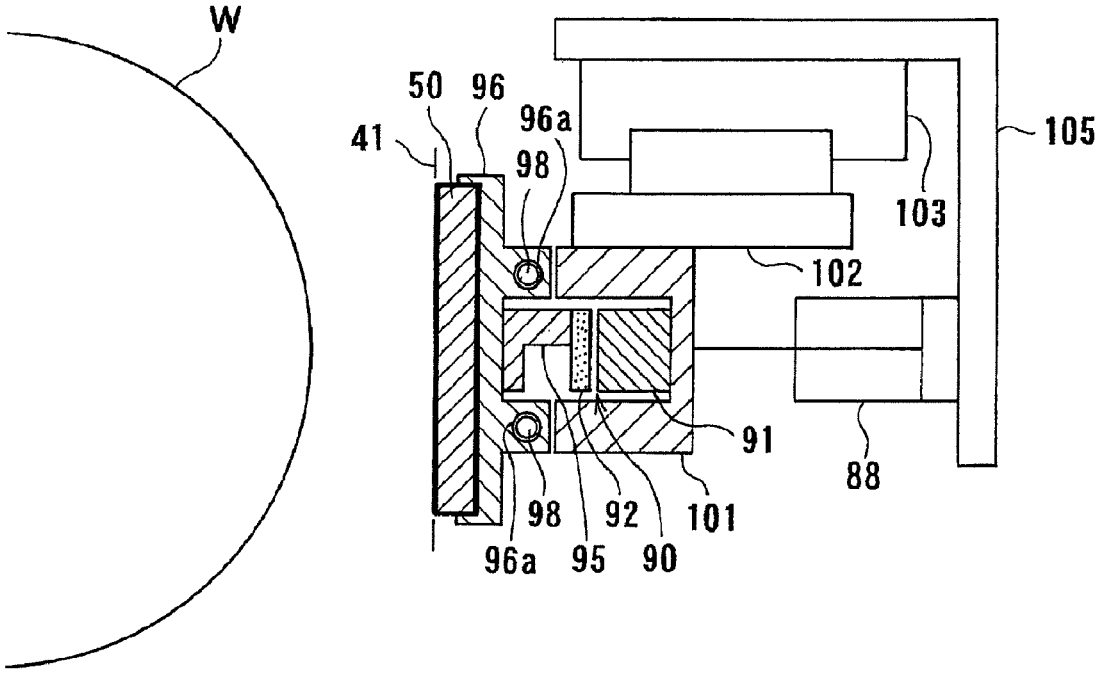
FIG. 9 is a horizontal cross-sectional view of the polishing head shown in FIG. 6.

FIG. 6 is a plan view showing interior structures of the polishing head 42 in FIG. 3. FIG. 7 is a cross-sectional view taken along line A-A in FIG. 6, FIG. 8 is a cross-sectional view taken along line B-B in FIG. 6, and FIG. 9 is a horizontal cross-sectional view of the polishing head shown in FIG. 6. As shown in FIGS. 6 through 9, the polishing head 42 includes a back pad (press pad) 50 having a pressing surface 50*a* for pressing the polishing surface of the polishing tape 41 against the wafer W. The polishing head 42 further includes a linear motor 90 configured to reciprocate the back pad 50. The polishing surface is a surface of the polishing tape 41 that faces the wafer W. The back pad 50 is disposed at a rear side of the polishing tape 41.

The linear motor 90 includes a permanent magnet 92 and an electromagnet 91 arranged adjacent to the permanent magnet 92. The permanent magnet 92 is in a shape of an elongated plate, and both ends of the permanent magnet 92 are magnetized to form a south pole and a north pole, respectively. The electromagnet 91 is held by an electromagnet holder 101. The electromagnet 91 has a core 91*a* having three legs extending toward the permanent magnet 92 and a coil 91*b* wound around the central leg. The core 91*a* has an E-shape when viewed from a lateral direction. This type of core is generally called "E core". The core 91*a* is formed by a plurality of laminated silicon steel plates.

Figure 10A:
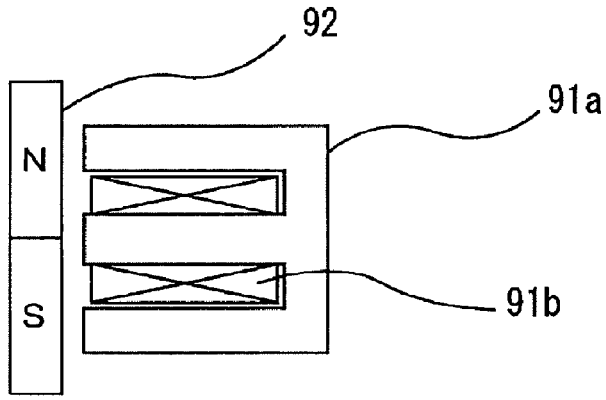
FIGS. 10A through 10C are schematic views illustrating reciprocation of a permanent magnet caused by magnetic force of an electromagnet.
Figure 10B:
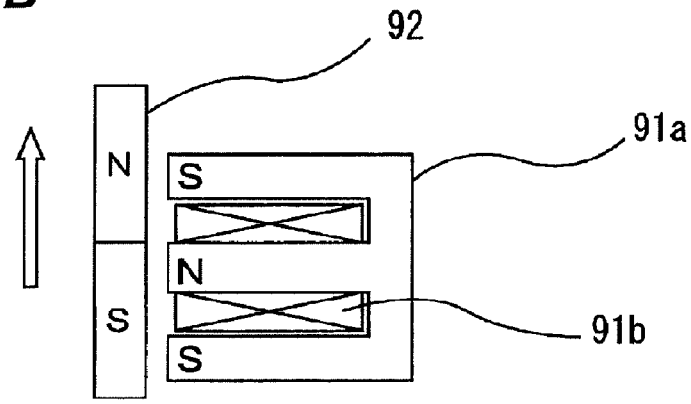
Figure 10C:
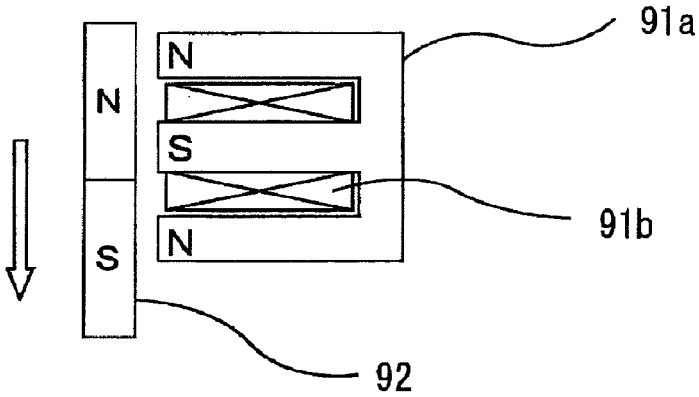

The coil 91*b* is electrically connected to a drive unit 93. The drive unit 93 is configured to supply alternating current of a predetermined frequency to the electromagnet 91. When the alternating current is supplied to the electromagnet 91, magnetic forces of south pole and north pole are induced alternately in the three legs of the core 91*a*. The permanent magnet 92, disposed adjacent to the edges of the legs, is reciprocated by the magnetic forces generated in the electromagnet 91, as shown in FIG. 10A through FIG. 10C.

As shown in FIG. 7, springs 94 are attached to both ends of the permanent magnet 92. End portions of the respective springs 94 are secured to an inner surface of the electromagnet holder 101. These springs 94 are provided for supporting the reciprocating motion of the permanent magnet 92. The permanent magnet 92 is coupled to a pad holder 96 via a first coupling block 95. The back pad 50 is secured to the pad holder 96. With this arrangement, the first coupling block 95, the pad holder 96, and the back pad 50 move integrally with the permanent magnet 92. The reciprocating motion of the back pad 50 is in directions perpendicular to a tangential direction of the disk-shaped wafer W held on the wafer stage 23.

As shown in FIG. 8 and FIG. 9, two first linear guides 98, which are arranged in parallel to each other, are secured to the electromagnet holder 101. These first linear guides 98 are disposed substantially parallel to the reciprocating direction of the permanent magnet 92. The above-described springs 94 are arranged in parallel to the first linear guides 98. The pad holder 96 has through-holes 96*a* that are formed in positions corresponding to the first linear guides 98, and the first linear guides 98 are inserted into the through-holes 96*a*, respectively. Resin bushings 99 are embedded in the through-holes 96*a* and the pad holder 96 is slidably supported by the first linear guides 98 through the bushings 99. A clearance extending along the first linear guides 98 is formed between the pad holder 96 and the electromagnet holder 101, so that the pad holder 96 can move freely relative to the electromagnet holder 101. This clearance is in the range of 1 mm to 4 mm.

With this arrangement, the direction of the reciprocating motion of the back pad 50 driven by the linear motor 90 is restricted to a linear direction by the first linear guides 98. During polishing, the back pad 50 and the polishing tape 41 reciprocate integrally via a frictional force generated therebetween. Clearances formed between the bushings 99 and the first linear guide 98 are extremely small, so that the polishing liquid supplied from the polishing liquid supply nozzle 58 does not enter the clearances and smooth movement of the back pad 50 is ensured.

When the electromagnet 91 is excited, an attractive force and a repulsive force are generated between the electromagnet 91 and the permanent magnet 92. If the first linear guides 98 are not provided, the permanent magnet 92 cannot perform a linear motion since it is affected by these attractive and repulsive forces. As a result, the abrasive particles on the polishing surface of the polishing tape 41 scratch the wafer, leaving gashes. In the present embodiment, the back pad 50 reciprocates linearly in parallel to the pressing surface 50*a* thereof. Accordingly, the above-mentioned problems do not occur.

As shown in FIG. 6, the electromagnet holder 101 is coupled to a second coupling block 103 via a second linear guide 102. The second coupling block 103 is secured to a housing 105 of the polishing head 42. An air cylinder 88 as a driving mechanism is coupled to the electromagnet holder 101. The air cylinder 88 is configured to move the linear motor 90, the first coupling block 95, the pad holder 96, and the back pad 50 toward the periphery of the wafer W. The air cylinder 88 can adjust a pressing force of the polishing surface of the polishing tape 41 against the wafer W.

The supply reel 45*a* and the recovery reel 45*b* shown in FIG. 3 exert an appropriate tension on the polishing tape 41 with use of motors (not shown) so as to prevent the polishing tape 41 from sagging. The tape-sending mechanism 43 is configured to send the polishing tape 41 at a constant speed from the supply reel 45*a* to the recovery reel 45*b*. This tape-sending speed is several millimeters to several tens of millimeters per minute (for example, 30 mm/min to 50 mm/min). On the other hand, the speed of the polishing tape 41 reciprocated by the linear motor 90 is very high and the amplitude of the polishing tape 41 is several millimeters. Therefore, in comparison with the speed and the amplitude of the reciprocating motion of the polishing tape 41, the sending speed of the polishing tape 41 can be mostly ignored. The reciprocating speed of the polishing tape 41 is determined by a frequency of the alternating current supplied to the linear motor 90. The frequency of the alternating current is preferably in the range of 10 Hz to 1000 Hz, and more preferably in the range of 100 Hz to 300 Hz.

Next, operations of the polishing apparatus thus constructed will be described. The wafer W is transported into the housing 11 through the opening 12 by the wafer transporting mechanism (not shown). The wafer chuck mechanism 80 receives the wafer W from the hand 85 (see FIG. 4) of the wafer transporting mechanism and grasps the wafer W with the first and second chuck hands 81 and 82. After transferring the wafer W to the first and second chuck hands 81 and 82, the hand 85 of the wafer transporting mechanism moves outside the housing 11 and then, the shutter 13 is closed. The wafer chuck mechanism 80, holding the wafer W, lowers the wafer W and places the wafer W onto the upper surface of the wafer stage 23. Then, the vacuum pump (not shown) is driven to attract the wafer W to the upper surface of the wafer stage 23.

Figure 1A:
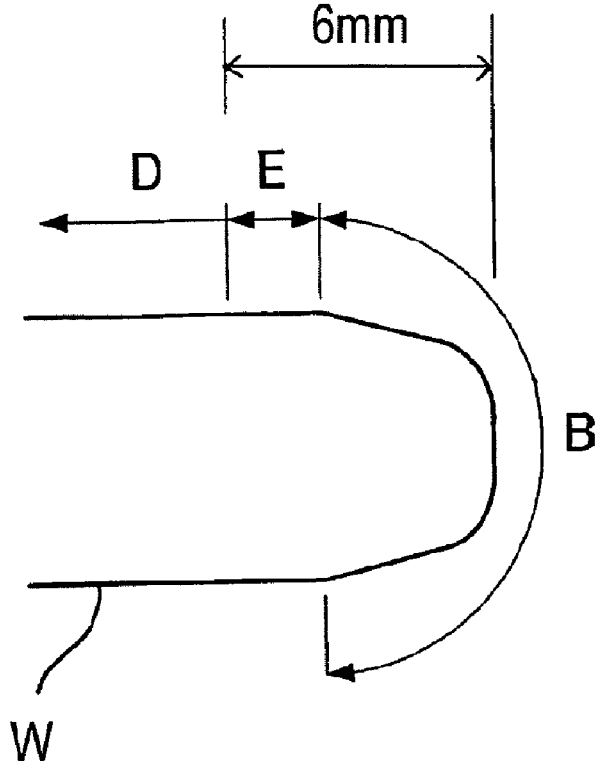
FIG. 1A is a cross-sectional view for illustrating a periphery of a wafer.
Figure 1B:
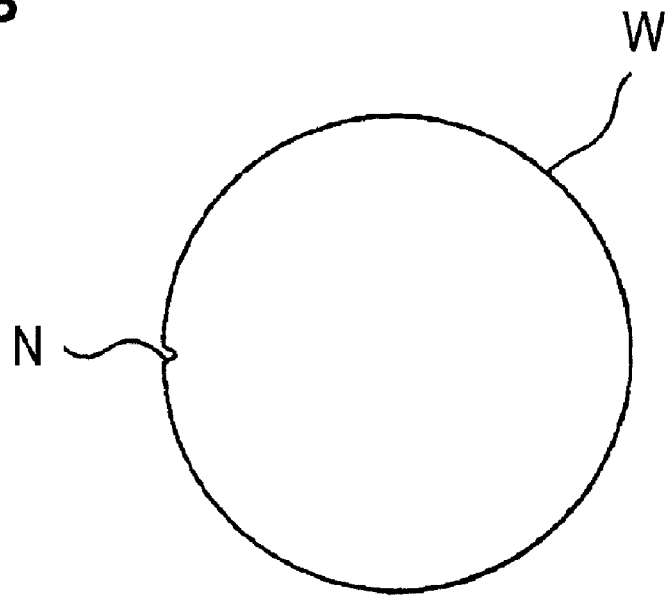
FIG. 1B is a plan view for illustrating a notch portion of the wafer.

Thereafter, the wafer stage 23, together with the wafer W, moves closer to the polishing head 42 by the stage moving mechanism 30. Subsequently, the wafer stage 23 is rotated by the motor m1 at a low speed, and then, supplying of the polishing liquid from the polishing liquid supply nozzle 58 onto the wafer W is started. When a flow rate of the polishing liquid reaches a predetermined value, the wafer W is moved by the stage moving mechanism 30 to a position where the wafer W is brought into contact with the polishing tape 41. Then, the back pad 50 and the polishing tape 41 are reciprocated at high speed by the linear motor 90. With this operation, the polishing surface of the polishing tape 41 is brought into sliding contact with the wafer W to polish the bevel portion of the wafer W. If necessary, the polishing head 42 may be tilted by the tilting mechanism so as to polish not only the bevel portion but also the edge-cut portion (see FIG. 1A).

According to the above-described embodiment, use of the linear motor 90 enables the polishing table 41 to reciprocate at a high speed. Therefore, a removal rate can be increased. Furthermore, since the polishing tape 41 can be moved at a high speed, the rotational speed of the wafer W during polishing can be decreased without decreasing relative speed between the wafer W and the polishing tape 41. During polishing, it is preferable that the wafer W be rotated at as low speed as possible (for example, at 100 $min^{-1}$ or less). Rotating the wafer W at low speed can prevent the polishing liquid from scattering off the wafer W. As a result, malfunction of devices caused by particles can be prevented.

Figure 11:
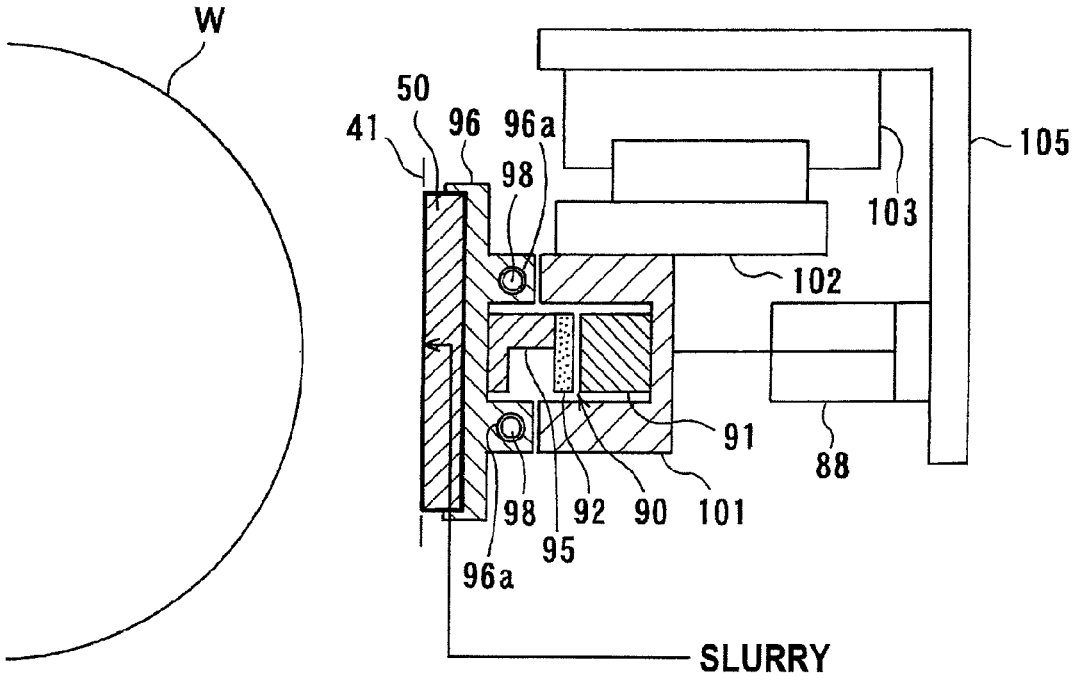
FIG. 11 is a plan view showing a modified example of the polishing apparatus according to the first embodiment of the present invention.

A tape-shaped nonwoven fabric can be used instead of the polishing tape. In this case, slurry is supplied as the polishing liquid from the polishing liquid supply nozzle 58. Further, in this case, as shown in FIG. 11, slurry may be supplied to the wafer from a rear surface of the nonwoven fabric through a small hole formed in the central portion of the back pad 50, without using the polishing liquid supply nozzle. Preferably, the hole formed in the back pad 50 have a diameter ranging from 0.5 mm to 3 mm. A plurality of holes may be provided.

Figure 12:
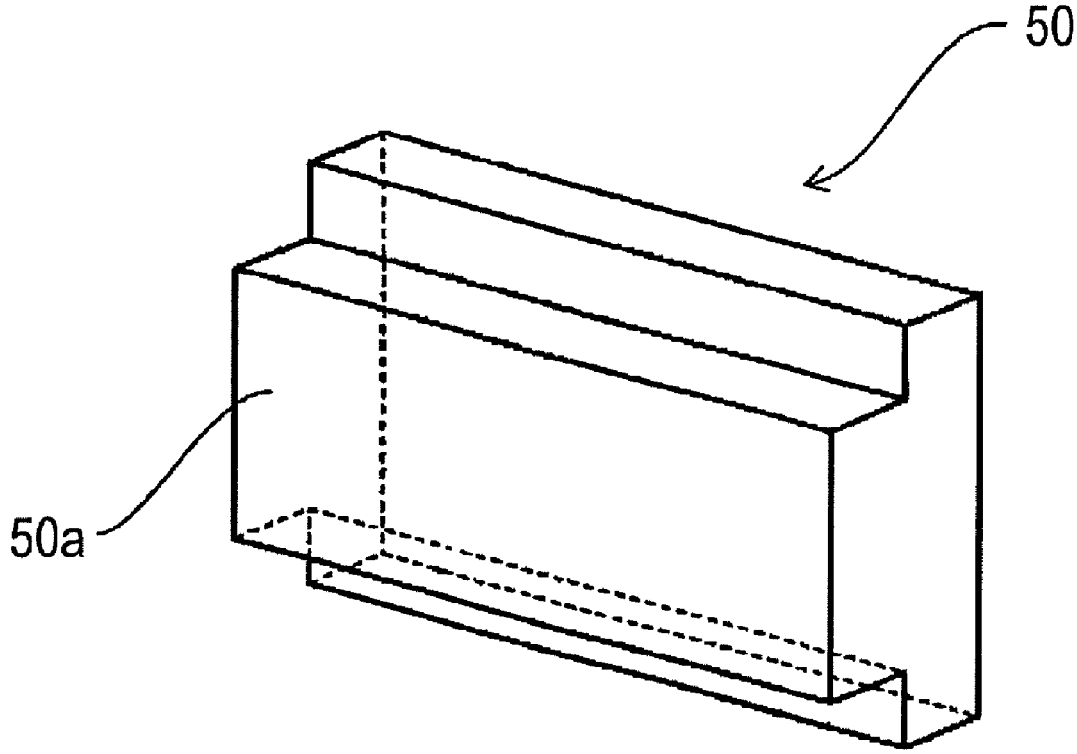
FIG. 12 is a perspective view showing a press pad.

Next, the back pad 50 that is incorporated in the above-described polishing head 42 will be described in detail. FIG. 12 is a perspective view showing the back pad 50. As shown in FIG. 12, the back pad 50 has a flat pressing surface 50*a* in a rectangular shape. The back pad 50 is disposed such that the pressing surface 50*a* faces the bevel portion of the wafer W held by the wafer stage 23 (see FIG. 3). The back pad 50 is fabricated from rubber, sponge, or the like. For example, urethane rubber or silicon sponge with a hardness (e.g., 20 to 40 degrees) suitable for polishing is selected as a material of the back pad.

Figure 13A:
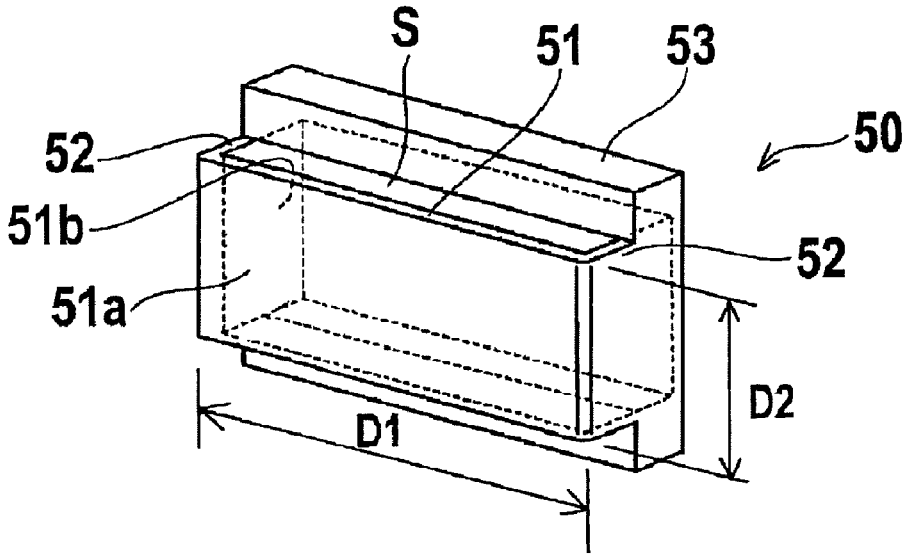
FIG. 13A is a perspective view showing a modified example of the press pad.
Figure 13B:
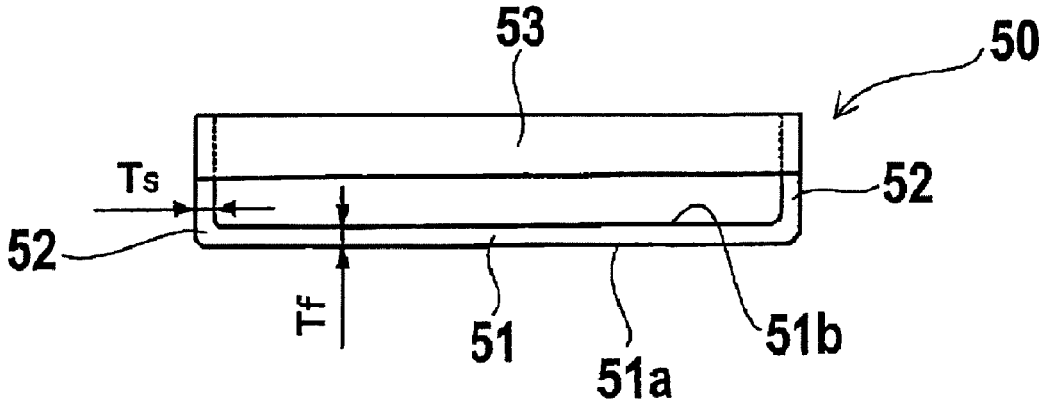
FIG. 13B is a top view showing the press pad shown in FIG. 13A.

FIG. 13A is a perspective view showing a modification example of the back pad 50 and FIG. 13B is a top view of the back pad shown in FIG. 13A.

As shown in FIGS. 13A and 13B, the back pad 50 has a plate-shaped pressing section 51 having a flat pressing surface 51*a*, two coupling sections 52 connected to both sides of the pressing section 51, and a pad body 53 to which these coupling sections 52 are secured. The pressing surface 51*a* has a rectangular shape, and a width (i.e., a dimension along a circumferential direction of the wafer W) D1 thereof is larger than a height (i.e., a dimension along a direction perpendicular to the surface of the wafer W) D2 thereof. In the present embodiment, a thickness Tf of the pressing section 51 and a thickness Ts of the coupling sections 52 are about 0.5 mm. The pressing section 51, the coupling sections 52, and the pad body 53 are integrally formed. The back pad 50 is made from rigid plastic (rigid resin), such as PVC (polyvinyl chloride). Use of such material allows the pressing section 51 to function as an elastic element having flexibility like a flat spring.

The coupling sections 52 are perpendicular to the pressing surface 51*a* and also perpendicular to the tangential direction of the wafer W on the wafer stage 23. Further, the two coupling sections 52 are arranged along the circumferential direction of the wafer W. There is a space S between a rear surface 51*b* of the pressing section 51 and the pad body 53. Specifically, the pressing section 51 is coupled to the pad body 53 only by the two coupling sections 52.

Figure 14:
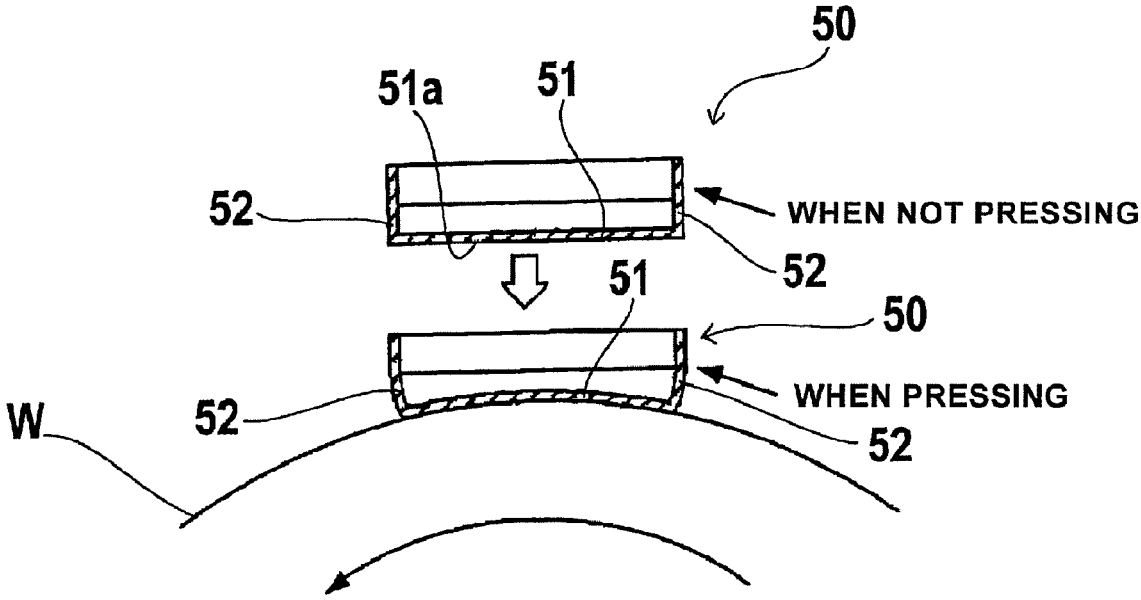
FIG. 14 is a plan view showing the press pad when pressing a wafer and when not pressing the wafer.

FIG. 14 is a plan view showing the back pad when pressing the wafer and when not pressing the wafer. The polishing tape 41 is not shown in FIG. 14. As shown in FIG. 14, when the back pad 50 is away from the wafer W, the pressing section 51 maintains its shape as it is, and the pressing surface 51*a* is flat. On the other hand, when the back pad 50 presses the wafer W, the pressing section 51 is bent along the circumferential direction of the wafer W. The two coupling sections 52 are also bent toward a center of the pressing section 51. Each coupling section 52 also has a plate shape and functions as an elastic element having flexibility like a flat spring.

Since the pressing section 51 and the coupling sections 52 are deformed (bent) in this manner, the pressing surface 51*a* contacts the bevel portion of the wafer W over an entire length of the pressing surface 51*a*. Therefore, a contact length between the wafer W and the polishing tape 41 becomes longer, compared with the back pad shown in FIG. 12. This contact length can be changed by the pressing force applied to the wafer W from the back pad 50, the thickness Tf of the pressing section 51, and the thickness Ts of the coupling sections 52.

Figure 15:
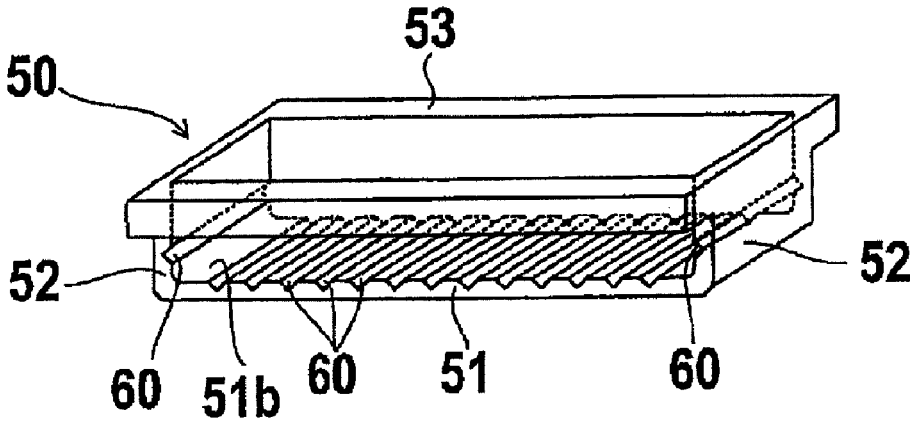
FIG. 15 is a perspective view showing another example of the press pad.

FIG. 15 is a schematic view showing another example of the back pad 50. Structures of the back pad in this example, which will not be described particularly, are identical to those of the back pad shown in FIGS. 13A and 13B, and repetitive explanations are omitted. In this example, a plurality of grooves 60, extending in a direction perpendicular to the tangential direction of the wafer W held on the wafer stage 23 (see FIG. 3), are formed on the rear surface 51*b* of the pressing section 51. These grooves are arranged in parallel to each other at equal intervals and each groove has a triangular cross section. Similarly, a groove 60, extending in the direction perpendicular to the tangential direction of the wafer W, is formed on an inner surface of each coupling section 52.

Figure 16:
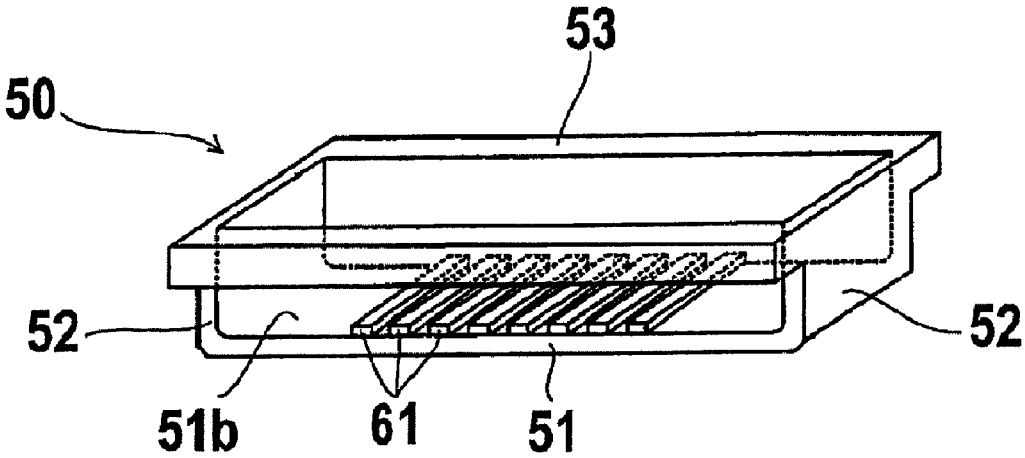
FIG. 16 is a perspective view showing another example of the press pad.

FIG. 16 is a perspective view showing another example of the back pad 50. Structures of the back pad, which will not be described particularly, are identical to those of the back pad shown in FIGS. 13A and 13B, and repetitive explanations are omitted. In this example, a plurality of reinforcing plates (reinforcing members) 61, extending in a direction perpendicular to the tangential direction of the wafer W held on the wafer stage 23 (see FIG. 3), are secured to the rear surface 51*b* of the pressing section 51. These reinforcing plates 61 are located near the center to the pressing section 51.

Figure 17:
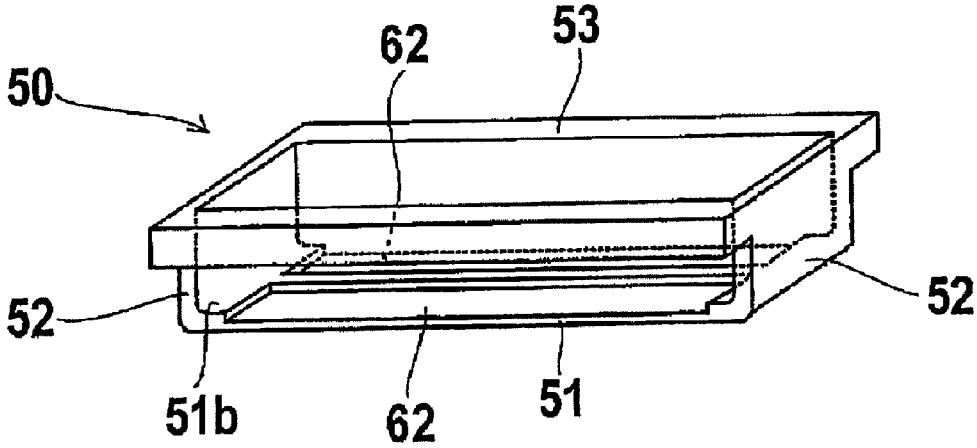
FIG. 17 is a perspective view showing another example of the press pad.

FIG. 17 is a perspective view showing another example of the back pad 50. Structures of the back pad, which will not be described particularly, are identical to those of the back pad shown in FIGS. 13A and 13B, and repetitive explanations are omitted. In this example, two recesses 62, extending in the tangential direction of the wafer W held on the wafer stage 23 (see FIG. 3), are formed on the rear surface 51*b* of the pressing section 51. No recess is formed at a rear side of the portion to be brought into contact with the bevel portion of the wafer W. Specifically, the pressing section 51 has its original thickness at a region between the above-described two recesses 62.

Figure 18:
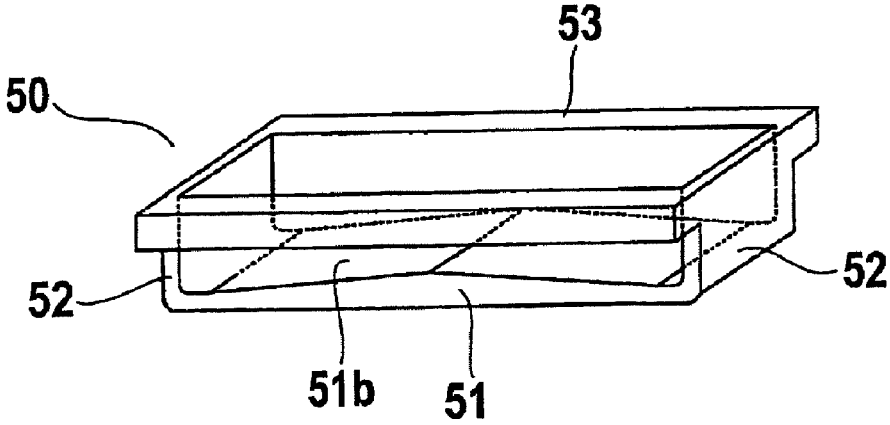
FIG. 18 is a perspective view showing another example of the press pad.

FIG. 18 is a perspective view showing another example of the back pad 50. Structures of the back pad, which will not be described particularly, are identical to those of the back pad shown in FIGS. 13A and 13B, and repetitive explanations are omitted. In this example, the rear surface 51*b* of the pressing section 51 slopes toward the center of the rear surface 51*b* from both sides thereof such that the thickness of the pressing section 51 increases linearly from the both sides to the center of the pressing section 51.

Figure 19A:
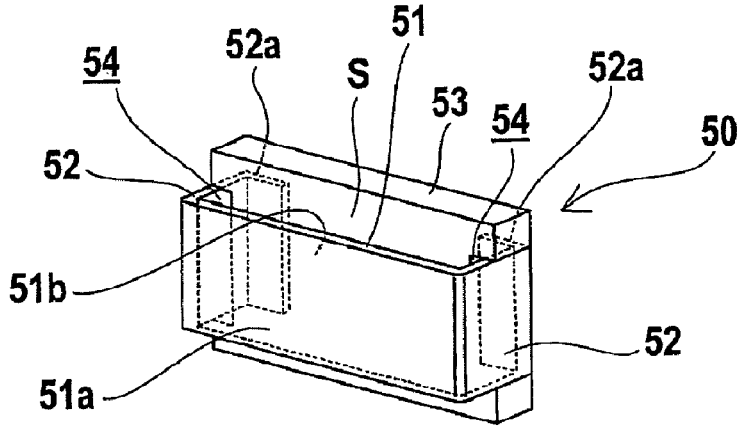
FIG. 19A is a perspective view showing another example of the press pad.
Figure 19B:
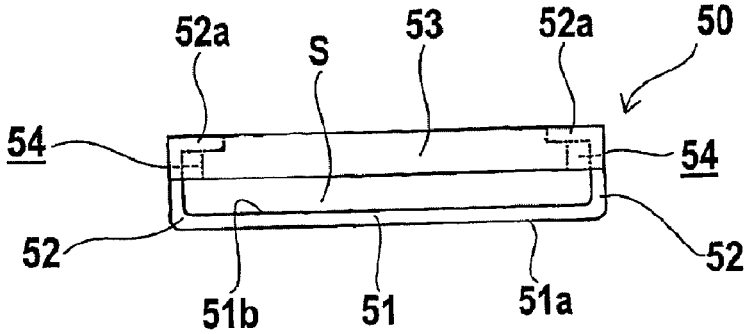
FIG. 19B is a top view of the press pad shown in FIG. 19A.
Figure 19C:
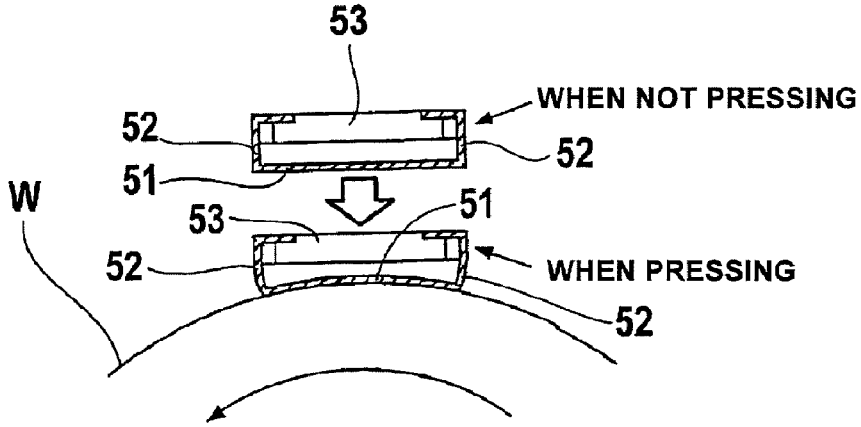
FIG. 19C is a plan view of the press pad when pressing a wafer and when not pressing the wafer.

FIG. 19A is a perspective view showing another example of the back pad 50, FIG. 19B is a top view of the back pad 50 shown in FIG. 19A, and FIG. 19C is a plan view showing the back pad when pressing the wafer and when not pressing the wafer. Structures of the back pad, which will not be described particularly, are identical to those of the back pad shown in FIGS. 13A and 13B, and repetitive explanations are omitted.

In this example, the pressing section 51 and the two coupling sections 52 are integrally formed, but the pad body 53 is provided as a separate member. The pressing section 51 and the two coupling sections 52 are made from rigid plastic (rigid resin), such as PVC (polyvinyl chloride). The pad body 53 is made from the same material. The respective coupling sections 52 have folded portions 52*a* extending inwardly at their ends, and these folded portions 52*a* and a rear surface of the pad body 53 are secured to each other with glue or the like.

The pad body 53 has substantially an H-shape as viewed from its front and there are clearances 54 between side surfaces of the pad body 53 and the coupling sections 52. By providing these clearances 54, the coupling sections 52 are not brought into contact with the pad body 53 when the coupling sections 52 are bent inwardly, as shown in FIG. 17C. Therefore, the pad body 53 does not interfere with the coupling sections 52 when they are bent inwardly. Further, the clearances 54 can reduce a shear force acting on junctions between the pad body 53 and the coupling sections 52 when the coupling sections 52 are bent inwardly.

The pressing section 51 and the two coupling sections 52 may be made from a different material from the pad body 53. For example, the pressing section 51 and the two coupling sections 52 may be integrally formed by using a special material, such as engineering plastic, and the pad body 53 may be made from another low-cost material. These configurations make it possible to reduce a production cost. Further, the coupling sections 52 and the pad body 53 may be joined to each other with an adhesive tape, so that the pressing section 51 and the coupling sections 52 can be replaceable.

Figure 20A:
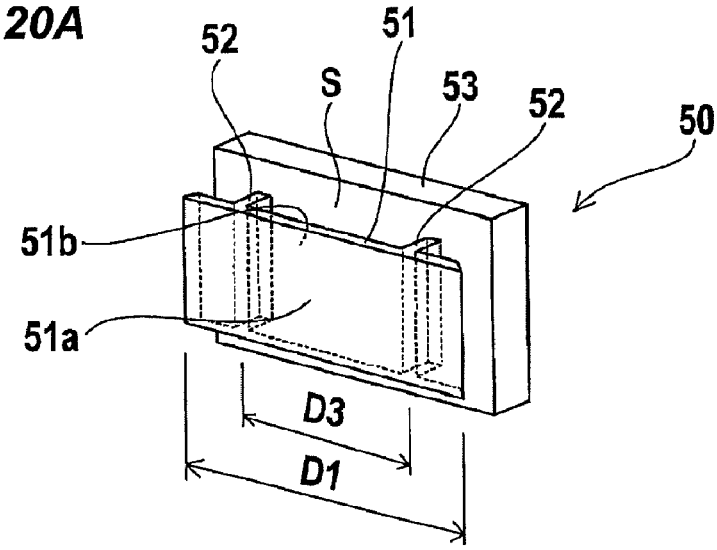
FIGS. 20A through 20C are views each showing another example of the press pad.
Figure 20B:
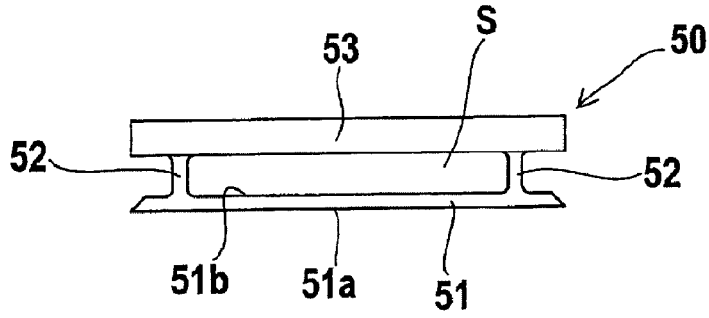
Figure 20C:
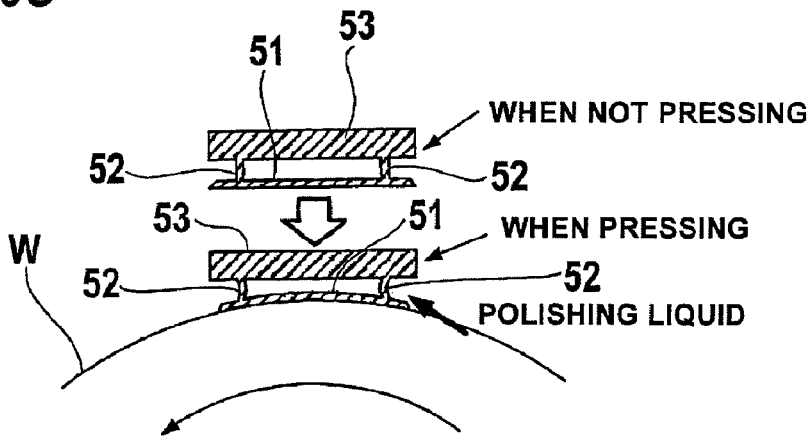

FIG. 20A is a perspective view showing another example of the back pad 50, FIG. 20B is a top view of the back pad 50 shown in FIG. 20A, and FIG. 20C is a plan view showing the back pad when pressing the wafer and when not pressing the wafer. Structures of the back pad, which will not be described particularly, are identical to those of the back pad shown in FIGS. 13A and 13B, and repetitive explanations are omitted. In this example, the two coupling sections 52 are connected to the rear surface 51*b* of the pressing section 51. These coupling sections 52 are located inwardly from both sides of the pressing section 51 toward the center thereof. Specifically, a distance D3 between the coupling sections 52 is smaller than the width D1 of the pressing section 51.

The back pad 50 thus constructed has the following advantages. As discussed above, the polishing liquid is supplied to the wafer W during polishing. This polishing liquid scatters from the wafer W due to the rotation of the wafer W, as shown in FIG. 20C. In the case where the coupling sections 52 are disposed on both sides of the pressing section 51, the polishing liquid, scattering from the wafer W, is likely to impinge upon the coupling sections 52 and bounce back onto the wafer W. According to the configuration shown in FIGS. 20A through 20C, the coupling sections 52 are located inwardly from the both sides of the pressing section 51. Therefore, the polishing liquid enters the rear side of the pressing section 51 and does not scatter onto the wafer W again. This configuration can prevent the polishing liquid from contacting again a region where devices are formed and can protect the devices from contamination.

Next, a second embodiment of the present invention will be described. The polishing apparatus according to the second embodiment is a notch polishing apparatus for polishing the notch portion of the wafer.

Figure 21:
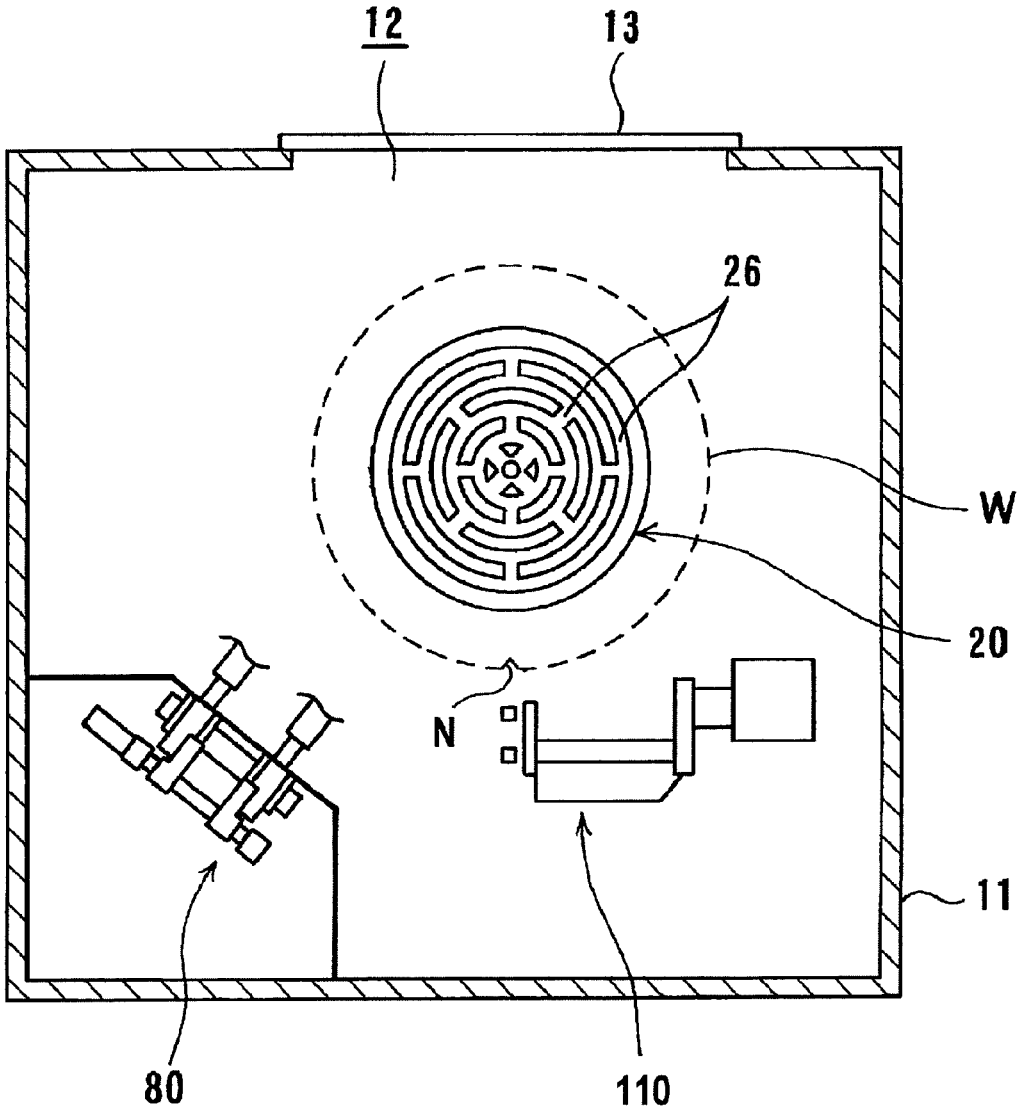
FIG. 21 is a plan view showing a polishing apparatus according to a second embodiment of the present invention.
Figure 22:
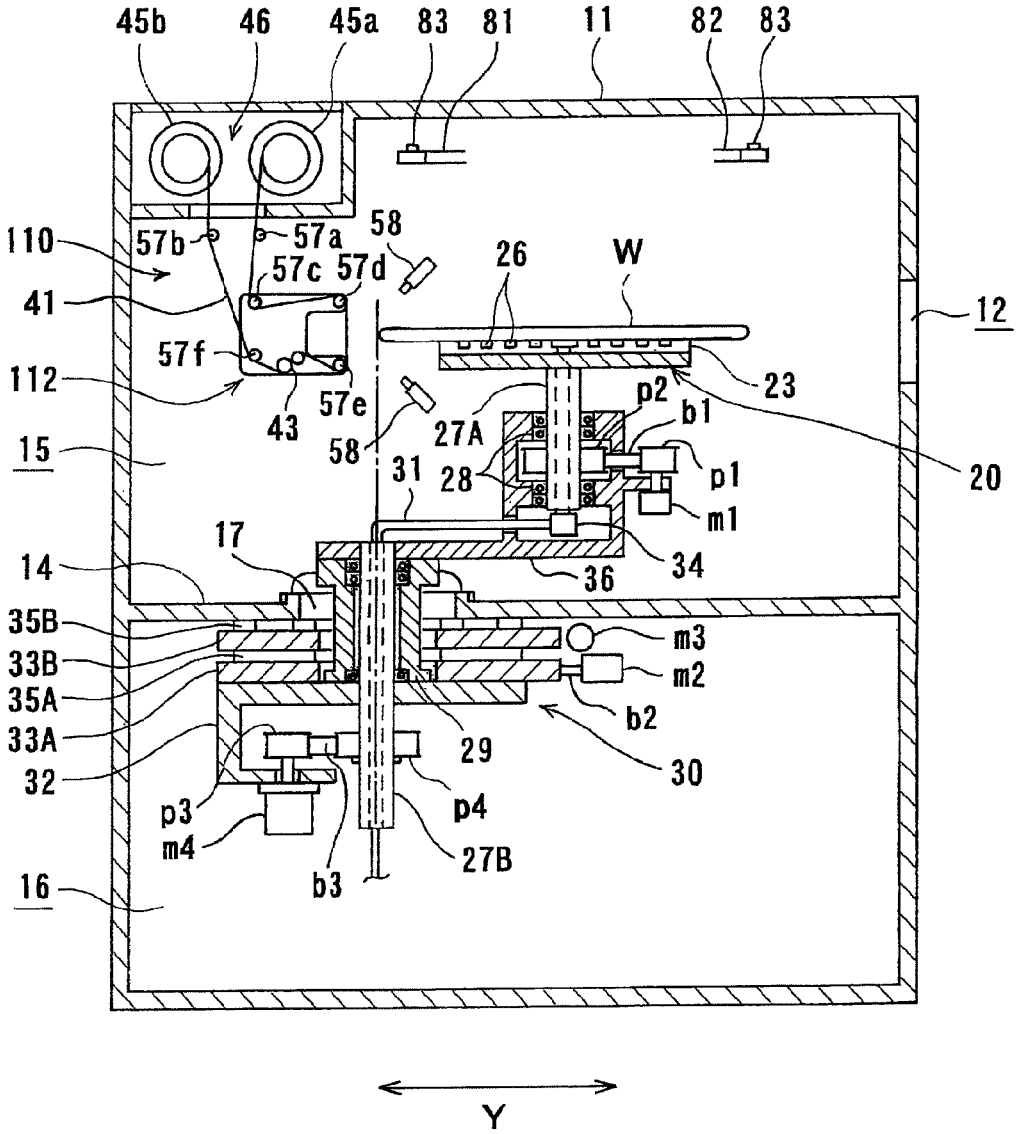
FIG. 22 is a cross-sectional view of the polishing apparatus shown in FIG. 21.

FIG. 21 is a plan view showing the polishing apparatus according to the second embodiment of the present invention. FIG. 22 is a cross-sectional view of the polishing apparatus shown in FIG. 21. Like or corresponding structural elements are denoted by the same reference numerals in the first embodiment and will not be described below repetitively.

As shown in FIGS. 21 and 22, the polishing apparatus according to the present embodiment includes the wafer stage unit (the substrate holder) 20 having wafer the holding stage 23 for holding a wafer, the stage moving mechanism 30 for moving the wafer stage unit 20 in the direction parallel to the upper surface (the wafer holding surface) of the wafer stage 23, and a notch polishing unit 110 for polishing a notch portion N of the wafer W held by the wafer stage 23.

A first hollow shaft 27A extending vertically is secured to the lower portion of the wafer stage 23, and the grooves 26 communicate with the vacuum pump (not shown) via the first hollow shaft 27A and a pipe 31. The first hollow shaft 27A is rotatably supported by the bearings 28 and is coupled to the motor m1 via the pulleys p1, p2 and the belt b1. The first hollow shaft 27A is coupled to the pipe 31 via a rotary joint 34. When the vacuum pump is set in motion, vacuum is produced in the grooves 26, whereby the wafer W is held on the upper surface of the wafer stage 23. The wafer W is rotated by the motor m1 while being held on the upper surface of the wafer stage 23. A rotating mechanism for rotating the wafer stage unit 20 is constituted by the hollow shaft 27A, the motor m1, the pulleys p1, p2, and the belt b1.

The pipe 31 extends through a second hollow shaft 27B and is coupled to the above-described vacuum pump. The second hollow shaft 27B extends vertically and is arranged in parallel to the first hollow shaft 27A. An extension of the second hollow shaft 27B is located on the periphery of the wafer W held on the upper surface of the wafer stage 23. The second hollow shaft 27B is rotatably supported by the cylindrical shaft base 29. The shaft base 29 extends through the through-hole 17 formed in the partition plate 14. The first hollow shaft 27A is coupled to the second hollow shaft 27B via a swing arm 36.

A lower end of the shaft base 29 is secured to the support plate 32. The support plate 32 is secured to a lower surface of a first movable plate 33A. An upper surface of the first movable plate 33A is coupled to a lower surface of a second movable plate 33B via linear guides 35A. With this arrangement, the first movable plate 33A can move relative to the second movable plate 33B. An upper surface of the second movable plate 33B is coupled to a lower surface of the partition plate 14 through linear guides 35B extending perpendicularly to the linear guides 35A. With this arrangement, the second hollow shaft 27B, the first hollow shaft 27A, and the wafer stage 23 can move in the direction parallel to the upper surface of the wafer stage 23.

The ball screw b2 is coupled to the first movable plate 33A and is also coupled to the motor m2. When the motor m2 rotates, the first movable plate 33A moves along a longitudinal direction of the linear guides 35A. Similarly, a ball screw (not shown) is coupled to the second movable plate 33B and a motor m3 is coupled to this ball screw. When the motor m3 rotates, the second movable plate 33B moves along a longitudinal direction of the linear guides 35B. Accordingly, the stage moving mechanism 30 is constituted by the first movable plate 33A, the linear guides 35A, the second movable plate 33B, the linear guides 35B, the ball screw (not shown), the ball screw b2, the motor m2, and the motor m3. In FIG. 22, the moving direction of the wafer stage 23 by the motor m2 of the stage moving mechanism 30 is indicated by arrows Y.

A motor m4 is secured to the support plate 32. This motor m4 is coupled to the second hollow shaft 27B via pulleys p3, p4 and a belt b3. The motor m4 is configured to rotate the second hollow shaft 27B by a predetermined angle in a clockwise direction and a counterclockwise direction alternately. Therefore, the wafer W on the wafer stage 23 swings or pivots in a horizontal plane around the second hollow shaft 27B as viewed from above. The polishing point (i.e., the notch portion) is located on the extension of the second hollow shaft 27B. Therefore, the motor m4, the pulleys p3, p4, and the belt b3 constitute a pivot mechanism for causing the wafer W to pivot around the polishing point.

Figure 23:
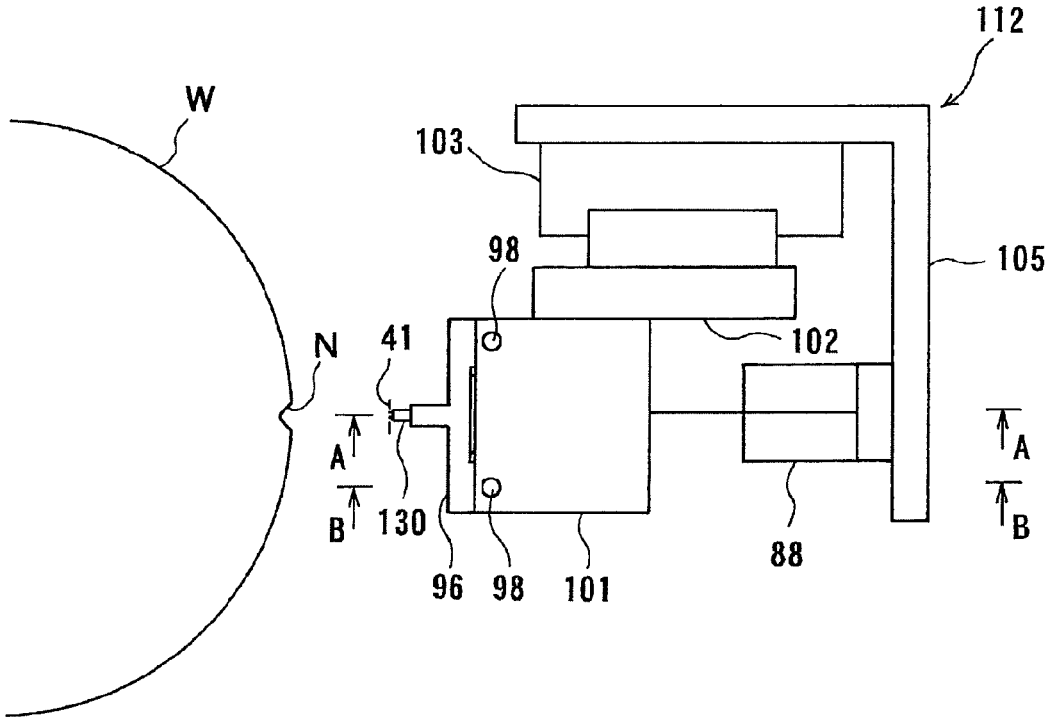
FIG. 23 is a plan view showing interior structures of a polishing head shown in FIG. 22.
Figure 24:
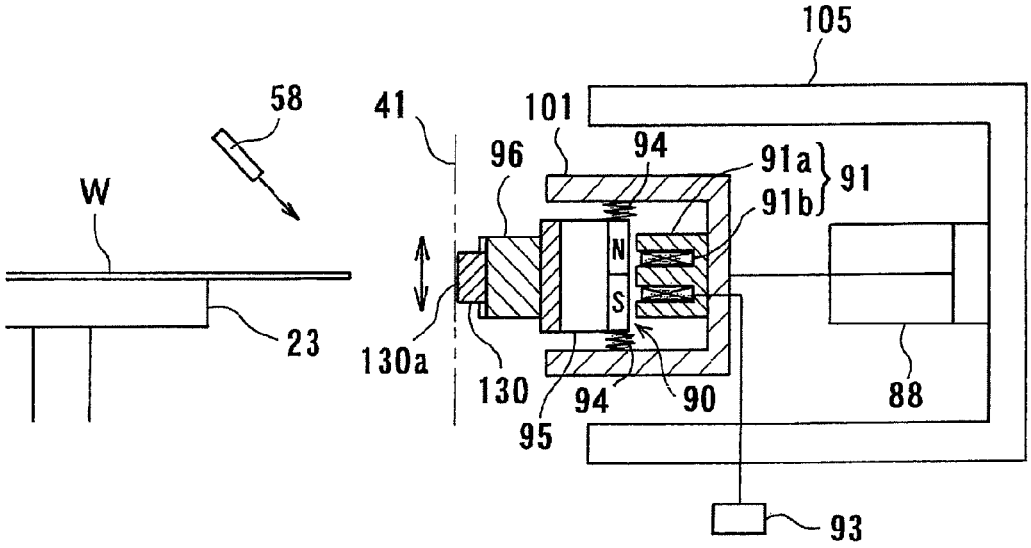
FIG. 24 is a cross-sectional view taken along line A-A in FIG. 23.
Figure 25:
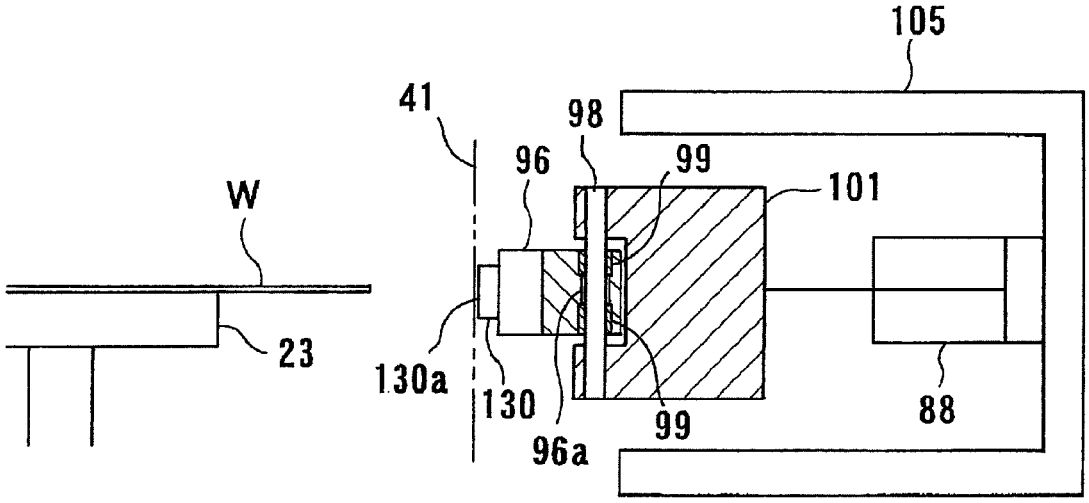
FIG. 25 is a cross-sectional view taken along line B-B in FIG. 23.
Figure 26:
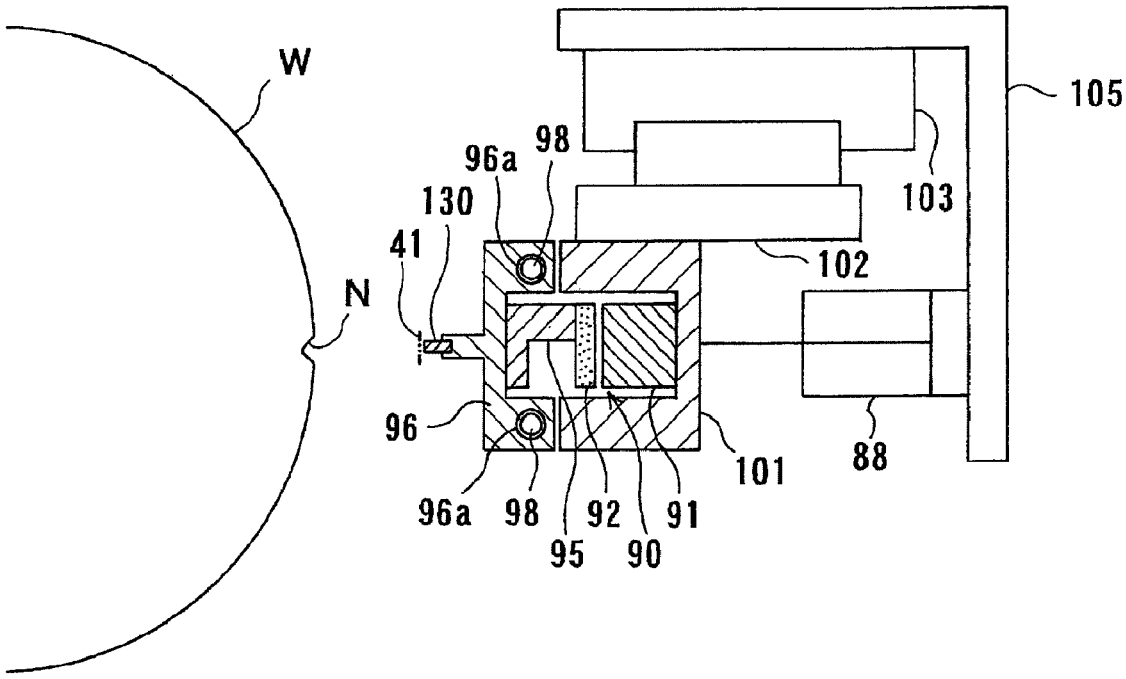
FIG. 26 is a horizontal cross-sectional view of the polishing head shown in FIG. 23.

FIG. 23 is a plan view showing interior structures of a polishing head 112 shown in FIG. 22. FIG. 24 is a cross-sectional view taken along line A-A in FIG. 23, FIG. 25 is a cross-sectional view taken along line B-B in FIG. 23, and FIG. 26 is a horizontal cross-sectional view showing the polishing head shown in FIG. 23. As shown in FIGS. 23 through 26, the interior structures of the polishing head 112 are basically the same as those of the polishing head 42 shown in FIGS. 6 through 9, except that a back pad 130 has a pressing surface 130*a* with a smaller width than that of the notch portion N of the wafer W. The width of the polishing tape 41 is slightly larger than that of the notch portion N.

Next, operations of the polishing apparatus thus constructed will be described. The wafer W is transported into the housing 11 through the opening 12 by the wafer transporting mechanism (not shown). The wafer chuck mechanism 80 receives the wafer W from the hand 85 (see FIG. 4) of the wafer transporting mechanism and grasps the wafer W with the first and second chuck hands 81 and 82. After transferring the wafer W to the first and second chuck hands 81 and 82, the hand 85 of the wafer transporting mechanism moves outside the housing 11 and then, the shutter 13 is closed. The wafer chuck mechanism 80, holding the wafer W, lowers the wafer W and places the wafer W onto the upper surface of the wafer stage 23. Then, the vacuum pump (not shown) is driven to attract the wafer W to the upper surface of the wafer stage 23.

Thereafter, the wafer stage 23, together with the wafer W, moves closer to the polishing head 42 by the stage moving mechanism 30. Subsequently, the wafer stage 23 is rotated by the motor m1 until the notch portion N faces the polishing head 112. Then, supplying of the polishing liquid from the polishing liquid supply nozzle 58 onto the wafer W is started. When the flow rate of the polishing liquid reaches a predetermined value, the wafer W is moved by the stage moving mechanism 30 to a position where the wafer W is brought into contact with the polishing tape 41. Then, the polishing head 112 is reciprocated by the linear motor 90. With this operation, the polishing surface of the polishing tape 41 is brought into sliding contact with the notch portion N. In this manner, the notch portion N of the wafer W is polished. If necessary, the polishing head 112 may be tilted by the tilting mechanism around the notch portion N (i.e., the polishing point) in a plane perpendicular to the wafer stage 23, or may pivot on the notch portion N in a plane parallel to the wafer stage 23 by the pivot mechanism.

A tape-shaped nonwoven fabric can be used instead of the polishing tape 41. In this case, slurry is supplied as a polishing liquid from the polishing liquid supply nozzle 58. The back pad may comprise a fixed abrasive pad that is formed from a rubber impregnated with abrasive particles, and the back pad (fixed abrasive pad) may be directly brought into sliding contact with the notch portion N of the wafer W without the polishing tape. The rubber impregnated with abrasive particles is formed by kneading abrasive particles, such as diamond particles, into an elastic material, such as silicon. The polishing head 42 according to the first embodiment may be provided in the housing 11, so that both the bevel portion and the notch portion can be polished by one polishing apparatus.

Figure 27:
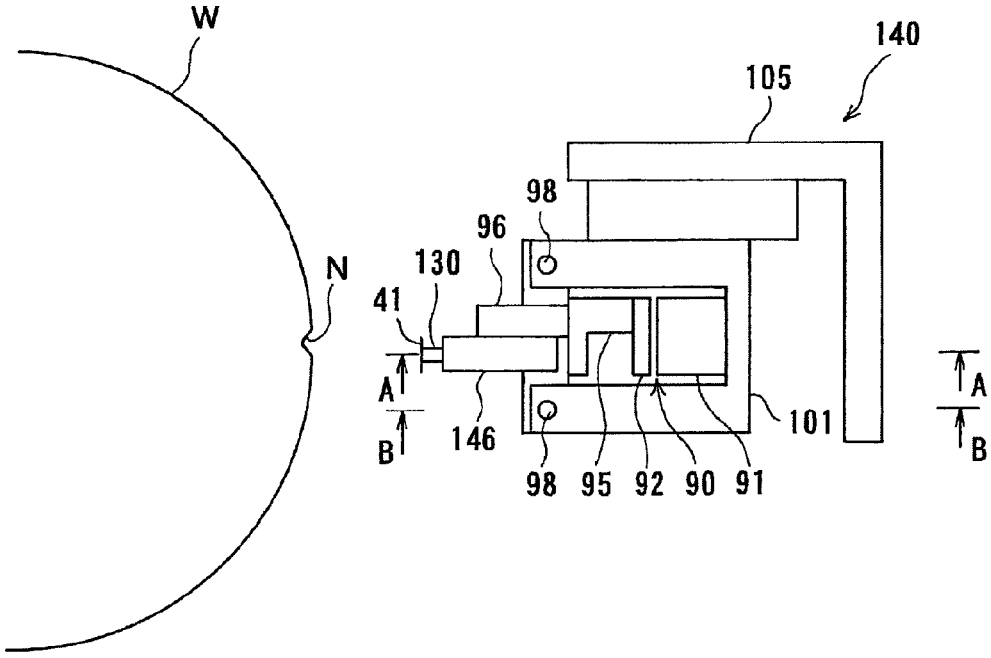
FIG. 27 is a plan view showing a polishing head used in a polishing apparatus according to a third embodiment of the present invention.
Figure 28:
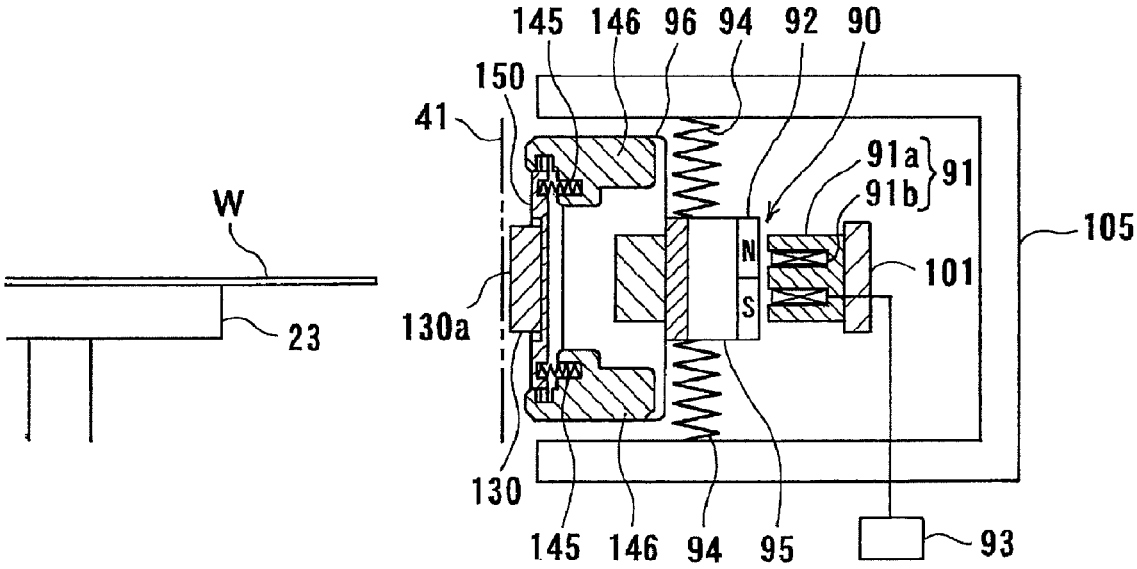
FIG. 28 is a cross-sectional view taken along line A-A in FIG. 27.
Figure 29:
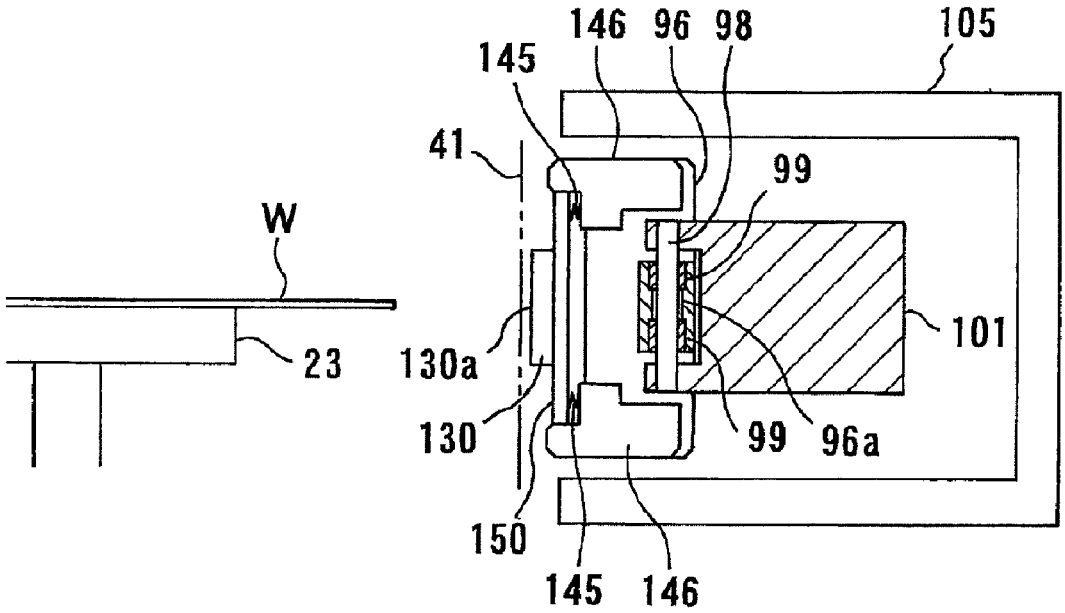
FIG. 29 is a cross-sectional view taken along line B-B in FIG. 27.
Figure 30:
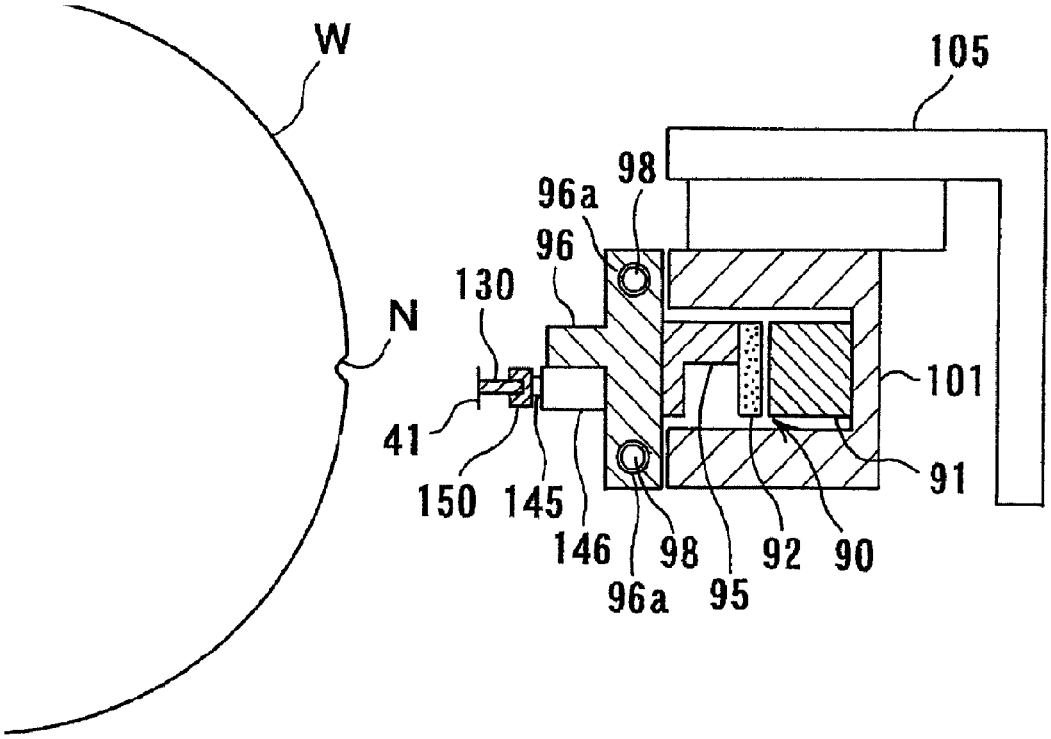
FIG. 30 is a horizontal cross-sectional view of the polishing head shown in FIG. 27.

FIG. 27 is a plan view showing a polishing head used in a polishing apparatus according to a third embodiment of the present invention. FIG. 28 is a cross-sectional view taken along line A-A in FIG. 27, FIG. 29 is a cross-sectional view taken along line B-B in FIG. 27, and FIG. 30 is a horizontal cross-sectional view of the polishing head shown in FIG. 27. Structures of the polishing apparatus according to the present embodiment are basically the same as those of the second embodiment. Like or corresponding structural elements are denoted by the same reference numerals in the second embodiment and will not be described below repetitively.

A polishing head 140 according to the present embodiment does not have the air cylinder. An electromagnet holder 101 is secured to the housing 105 of the polishing head 140. Both ends of the coupling block 95, which is to move integrally with the permanent magnet 92, are supported by the springs 94. The ends of these springs 94 are secured to the housing 105 of the polishing head 140. Pad holder 96 is secured to the coupling block 95. The pad holder 96 and the electromagnet holder 101 are coupled to each other via the linear guides 98. Therefore, the pad holder 96 moves linearly relative to the electromagnet holder 101.

In the present embodiment, a back pad 130 is supported by springs 145. More specifically, spring holders 146 are secured to both ends of the pad holder 96, and the springs 145, extending toward the wafer W, are attached to these spring holders 146, respectively. The back pad 130 is secured to a rod-shaped support member 150 arranged in parallel to the linear guides 98. The pad holder 96 and the support member 150 are coupled to each other via the springs 145. The back pad 130 is biased toward the polishing tape 41 by the springs 145. A small clearance is formed between each end of the support member 150 and each spring holder 146, so that the support member 150 can move relative to the pad holder 96.

Polishing operation of the present embodiment is the same as the polishing operation of the above-described second embodiment. According to the present embodiment, the pressing force of the back pad 130 is automatically adjusted by the springs 145. Therefore, the back pad 130 can apply a constant pressing force to the wafer W at all times.

The previous description of embodiments is provided to enable a person skilled in the art to make and use the present invention. Therefore, the present invention is not limited to the above-described embodiments. It should be understood that various changes and modifications may be made without departing from the scope of claims for patent and the scope of the technical concept described in the specification and drawings.

INDUSTRIAL APPLICABILITY

The present invention is applicable to a polishing apparatus for polishing a periphery of a substrate, such as a semiconductor wafer.

The invention claimed is:

1. A polishing apparatus for polishing a periphery of a substrate by bringing a polishing tool into sliding contact with the periphery of the substrate, said polishing apparatus comprising:

a substrate holder configured to hold the substrate; and a polishing head configured to polish the periphery of the substrate held by said substrate holder using the polishing tool, wherein said polishing head includes a press pad for pressing the polishing tool against the periphery of the substrate, and a linear motor configured to reciprocate said press pad in a direction perpendicular to a tangential direction of the substrate when said press pad is pressing the polishing tool against the periphery of the substrate.

2. The polishing apparatus according to claim 1, wherein said polishing head has a linear guide configured to restrict a reciprocating motion of said press pad to a linear reciprocating motion.

3. The polishing apparatus according to claim 1, wherein said press pad includes:

a pad body;

a plate-shaped pressing section having a pressing surface for pressing the polishing tool against the periphery of the substrate and having a rear surface opposite to said pressing surface; and a plurality of coupling sections coupling said plate-shaped pressing section to said pad body, a space being formed between said rear surface of said plate-shaped pressing section and said pad body.

4. The polishing apparatus according to claim 1, wherein said polishing head includes a driving mechanism configured to move said press pad and said linear motor toward the periphery of the substrate.

5. The polishing apparatus according to claim 1, further comprising a tilting mechanism configured to tilt said polishing head with respect to a surface of the substrate held by said substrate holder.

6. The polishing apparatus according to claim 1, wherein the polishing tool is a polishing tape having a polishing surface.

* * * * *

UNITED STATES PATENT AND TRADEMARK OFFICE

CERTIFICATE OF CORRECTION

PATENT NO. : 8,393,935 B2
APPLICATION NO. : 12/673294
DATED : March 12, 2013
INVENTOR(S) : Kimura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 338 days.

Signed and Sealed this
Twenty-first Day of April, 2015

Michelle K. Lee

Michelle K. Lee
*Director of the United States Patent and Trademark Office*